US005982255A

United States Patent [19]

Tanizaki et al.

[11] Patent Number: 5,982,255

[45] Date of Patent: Nov. 9, 1999

[54] LSM AND LSE MODE DIELECTRIC WAVEGUIDE HAVING PROPAGATING AND NON-PROPAGATING REGIONS

[75] Inventors: Toru Tanizaki, Kyoto; Hiroshi Nishida, Kawanishi; Atsushi Saitoh, Nagaokakyo, all of Japan

[73] Assignee: Murata Manufacturing Co., Ltd., Japan

[21] Appl. No.: 08/724,773

[22] Filed: Oct. 3, 1996

[30] Foreign Application Priority Data

Oct. 4, 1995 [JP] Japan ..... 7-257803

[51] Int. Cl.[6] ..... H01P 3/16

[52] U.S. Cl. ..... 333/239; 333/248; 333/249

[58] Field of Search ..... 333/239, 248, 333/249

[56] References Cited

U.S. PATENT DOCUMENTS

| | | | |
|---|---|---|---|
| 4,463,330 | 7/1984 | Yoneyama | 333/239 |
| 5,770,989 | 6/1998 | Ishikawa et al. | 333/248 |

FOREIGN PATENT DOCUMENTS

| | | | |
|---|---|---|---|
| 6268415 | 9/1994 | Japan | 333/239 |
| 1532983 | 12/1989 | U.S.S.R. | 333/239 |
| 2275826 | 9/1994 | United Kingdom . | |

OTHER PUBLICATIONS

Lanfen, Qi et al., "Development of Groove NRD Waveguide Circulator", The 3rd Asia–Pacific Microwave Conference Proceedings, pp. 11–14, Tokyo, 1990.

Ma, Zhewang et al., "Wave Leakage From Groove NRD Structures", IEEE Microwave and Guided Wave Letters, vol. 3, No. 6, pp. 170–172, Jun. 1993.

Miao, Jing–Feng, "Studies of NRD Waveguide in China", Progress in Electromagnetics Research Symposium, p. 203, Piers 1997.

Tong, C. E. et al, "Study of Groove Nonradiative Dielectric Waveguide", Electronic Letters, vol. 25, No. 14, pp. 934–936, Jul. 6, 1989.

Wu, Ke, "A Combined Efficient Approach for Analysis of Nonradiative Dielectric (NRD) Waveguide Components", IEEE Transactions on Microwave Theory and Techniques, vol. 42, No. 4, pp. 672–677, Apr. 1994.

Xiao, Li Ling et al., "Analysis of the Mono–Groove NRD Waveguide and Antenna", International Journal of Infrared and Millimeter Waves, pp. 361–370 (1988).

Yoneyama, Tsukasa et al., "Experiments on NRD–Guide at X–Band", The Bulletin of the Faculty of Engineering of Ryukyu University, pp. 111 and 119–122 (1986).

Zhang, Wen–Xun et al., "New Leaky–Wave Antenna for Millimetre Waves Constructed from Groove NRC Waveguide", Electronic Letters, vol. 23, No. 22, pp. 1191–1192, Oct. 22, 1987.

(List continued on next page.)

*Primary Examiner*—Benny T. Lee

*Attorney, Agent, or Firm*—Ostrolenk, Faber, Gerb & Soffen, LLP

[57] ABSTRACT

A dielectric waveguide has a dielectric member disposed between a pair of parallel conductor flat surfaces, such that a propagating region and a non-propagating region are formed. The spacing between the conductor flat surfaces in the non-propagating region is determined to be smaller than that in the propagating region. The above-mentioned spacings and the dielectric constant of the dielectric member are determined such that the cut-off frequency of the $LSM_{01}$ mode propagating through the propagating region is lower than the cut-off frequency of the $LSE_{01}$ mode and that electromagnetic waves of both the $LSM_{01}$ mode and the $LSE_{01}$ mode are cut-off in the non-propagating region, so that any transmission loss attributable to a mode conversion between the $LSM_{01}$ mode and $LSE_{01}$ mode occurring at, for example, a bend of the waveguide is eliminated so as to facilitate production of the waveguide having a desired bend angle and radius of curvature.

11 Claims, 24 Drawing Sheets

OTHER PUBLICATIONS

Zhongxiang, Shen et al., "Dispersion Characteristics of Groove Nonradiative Dielectric Waveguide with Anisotropic Substrate", The 3d Asia–Pacific Microwave Conference Proceedings, pp. 19–22, Tokyo, 1990.

Zhu, Lei et al., "The Bandwidth of Single–Mode Operation in Groove NRD Waveguide", International Journal of Infrared and Millimenter Waves, pp. 371–379 (1988).

Japanese Laid–Open Utility Model Application 59–183002, Dec. 6, 1984.

T. Yoneyama, "Millimeter–Wave Integrated Circuits Using Nonradiative Dielectric Waveguide", *Electronics & Communications In Japan, Part II Electronics,* vol. 74, No. 2, Feb. 1, 1991, pp. 20–28.

L.L. Xiao, et al., "Analysis of Groove NRD Waveguide Bend Using the Coupled–Mode Theory", *International Journal of Infrared and Millimeter Waves,* vol. 13, No. 7, pp. 971–980, Jul. 1992.

FIG. 16A
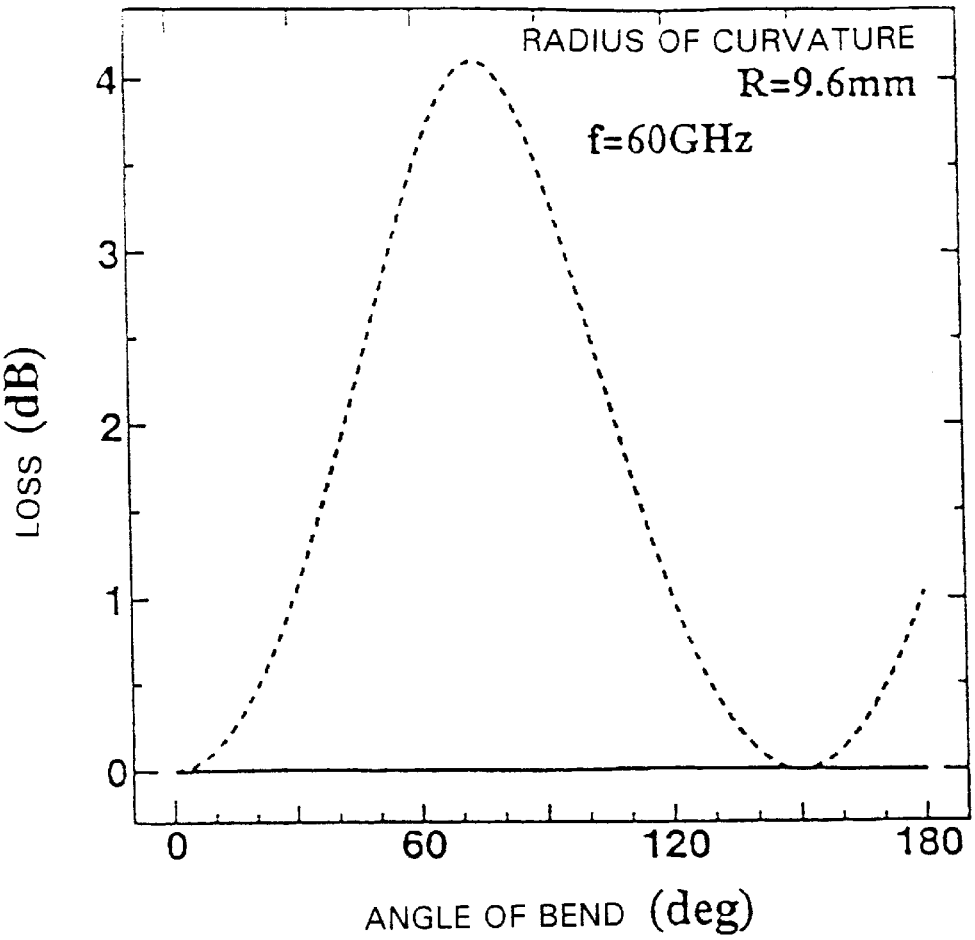
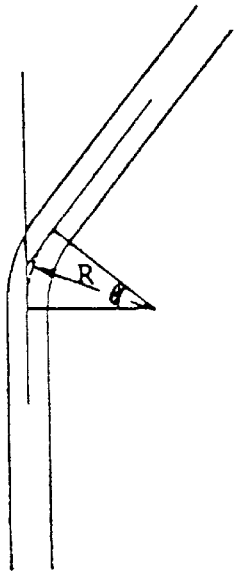
FIG. 16B

LSM AND LSE MODE DIELECTRIC WAVEGUIDE HAVING PROPAGATING AND NON-PROPAGATING REGIONS

CROSS-REFERENCE TO RELATED APPLICATIONS

This application is related to commonly assigned Ser. No. 08/699,158 filed Aug. 16, 1996, now U.S. Pat. No. 5,861,782, and Ser. No. 08/674,799 filed Jul. 3, 1996, now U.S. Pat. No. 5,770,989, the disclosures of which are incorporated by reference herein.

BACKGROUND OF THE INVENTION

1. Field of the Invention

The present invention relates to a dielectric waveguide suitable for use in a transmission line or an integrated circuit which operates in a millimeter wave band or a microwave band.

2. Description of the Related Art

FIGS. 26(A) to 26(D) show, in sectional views, four types of conventional dielectric waveguides which are known as NRD waveguides (non-radiative dielectric waveguides). The waveguide shown in FIG. 26(A) is of the type which is generally referred to as the "normal type", and has a dielectric strip 100 and a pair of parallel metallic plates 101 and 102 between which the dielectric strip 100 is disposed. The waveguide shown in FIG. 26(B) is of the so-called "grooved type", and has a pair of grooved metallic flat plates 101 and 102 and a dielectric strip 100 received in the grooves of the flat metal plates 101, 102. The waveguide shown in FIG. 26(C) is of the type known as the "insulated type" in which a dielectric strip 100 is interposed between conductive plates 105 and 106 through intermediaries of dielectric layers 103 and 104 of a small dielectric constant. The waveguide shown in FIG. 26(D) is of the type which is referred to as the "winged type", and has a pair of dielectric strips 107 and 108 each having wings, and conductors 109 and 110 which are formed on flat portions of the dielectric strips 107 and 108, the dielectric strips 107, 108 being adjoined such that they face in opposite directions.

A dielectric waveguide of the normal type is disclosed in, for example, JP-B-62-35281. A dielectric waveguide of the grooved type is disclosed in JU-A-59-183002. A dielectric waveguide of the insulated type is disclosed in JP-B-1-51202. A dielectric waveguide of the winged type is disclosed in JP-A-6-260814.

These known types of dielectric waveguides have their own respective advantages offered by their structural features. These dielectric waveguides can operate in two transmission modes, one of which is the LSM mode while the other is the LSE mode. Usually, the LSM mode, in particular the $LSM_{01}$ mode, is preferentially used because of its small transmission loss. A magnetic field distribution pattern peculiar to the $LSM_{01}$ mode and a magnetic field distribution pattern peculiar to the $LSE_{01}$ mode are shown by way of example in FIGS. 7(A) and 7(B), respectively. It is to be understood that conductors such as metallic flat plates disposed on the upper and lower sides of a dielectric strip 100 are omitted. Solid curvilinear lines with arrows indicate electric lines of force, while broken curvilinear lines with arrows indicate magnetic lines of force. FIGS. 8(A), 8(B) and FIGS. 9(A), 9(B) respectively show, by way of example, dispersion curves obtained with known dielectric waveguides of the normal type and known dielectric waveguides of the grooved type (FIGS. 8(A) and 9(A)) respectively, as well as calculation modes (FIGS. 8(B) and 9(B)). From these Figures, it will be seen that the $LSE_{01}$ mode is the mode of the lowest order, and that the $LSM_{01}$ mode, which is the transmission mode to be used, is of a higher order. This poses a risk that the $LSE_{01}$ mode may unexpectedly occur regardless of the frequency when the $LSM_{01}$ mode is being used. It is therefore necessary to take suitable measures for eliminating any influence which may be caused by occurrence of the $LSE_{01}$ mode.

For instance, occurrence of the $LSE_{01}$ mode takes place when the electromagnetic wave impinges upon a discontinuous portion of a dielectric strip 100 which exhibits lateral asymmetry of the $LSM_{01}$ mode, as in the case of a bend as shown in FIG. 27. Although an upper metallic flat plate 101 is spaced from the dielectric strip 100 in FIG. 27, it will be clear that the plate 101 is assembled together with the dielectric strip 100 and a lower metallic flat plate 102 when the dielectric waveguide is subjected to use. The cut-off frequency in the $LSE_{01}$ mode is lower than that in the $LSM_{01}$ mode, so that the wave in the $LSE_{01}$ mode propagates through the dielectric strip, causing a periodic repetition of a process in which part of the transmitted electric power of the $LSM_{01}$ mode is converted into the $LSE_{01}$ mode at the discontinuous portion and is then completely converted back into the $LSM_{01}$ mode. It is therefore possible to minimize the loss at the bend, by designing the bend such that the electric power is fully converted into the $LSM_{01}$ mode at the end of the bend. Conditions for achieving such a design, however, are extremely restricted and, therefore, it has been extremely difficult to construct a bend having a desired bend angle and radius of curvature.

FIGS. 28(A) and 28(B) show, by way of example, a circulator which is composed of three dielectric strips 100 and a pair of ferrite discs 32 and which operates under a D.C. biasing magnetic field $H_{OC}$. When an electromagnetic wave of the $LSM_{01}$ mode propagates from a port P1 to a port P3 as shown in FIG. 28(A), propagation of an electromagnetic wave of the $LSE_{01}$ mode towards a port P3 also takes place, resulting in an increase of the loss. In FIGS. 28(A) and 28(B), broken-line loops show distributions of magnetic fields, and upper and lower conductors which also are components of the circulator are omitted. An effective measure for eliminating the undesirable influence of the $LSE_{01}$ mode is to provide each dielectric strip with a mode suppressor 109*a* as shown in FIG. 28(B). The mode suppressor 109*a* is provided in its core portion with a conductor which extends vertically as shown, and is operative so as to suppress or attenuate only the $LSE_{01}$ mode. This measure, however, is not recommended, since it requires provision of suppressors which occupy considerable space.

Another problem is that, when it is desired to arrange, for example, a pair of dielectric strips in a mutually crossing manner, these strips have to be disposed at different heights or levels in order to eliminate interference between the electromagnetic waves propagating through these strips. Such a three-dimensional arrangement undesirably increases the dimensions of the whole device.

SUMMARY OF THE INVENTION

Accordingly, it is an object of the present invention to provide a dielectric waveguide which is free from the problem of transmission loss attributable to the aforementioned mode conversion.

It is another object of the present invention to provide a dielectric waveguide which permits easy design and production of a bend having a desired bend angle and radius of curvature.

It is still another object of the present invention to provide a dielectric waveguide which permits easy fabrication of a circulator free from influence of the $LSE_{01}$ mode, without requiring the use of any mode suppressor.

It is a further object of the present invention to provide a dielectric waveguide which allows a pair of dielectric strips to cross each other in a common plane, without causing interference between the electromagnetic waves propagating through the respective dielectric strips, thereby reducing dimensions of the whole structure.

To these ends, according to a first aspect of the present invention, there is provided a dielectric waveguide, comprising: a substantially parallel pair of conductor flat surfaces; and a dielectric strip interposed between the pair of conductor flat surfaces, the dielectric strip providing a propagating region which propagates an electromagnetic wave, while the portions devoid of the dielectric strip provide a non-propagating region which cuts off the electromagnetic wave.

In order to eliminate transmission loss which is attributable to the aforementioned conversion of mode occurring at a bend, in this aspect as well as the other aspects of the invention described below, the spacing h2 between the conductor flat surfaces in the non-propagating region is determined to be smaller than the spacing h1 between the conductor flat surfaces in the propagating region; the cut-off frequency of the $LSM_{01}$ mode propagating through the propagating region is lower than the cut-off frequency of the $LSE_{01}$ mode; and electromagnetic waves of both the $LSM_{01}$ mode and the $LSE_{01}$ mode are cut-off in the non-propagating region.

According to the first aspect of the invention, the spacings h1 and h2, the dielectric constant $\in 1$ of the dielectric strip in the propagating region and the dielectric constant $\in 2$ of a dielectric layer formed in the non-propagating region are determined to meet the above-mentioned cut-off conditions.

The dielectric waveguide of the present invention may have, between the pair of conductor flat surfaces, a dielectric layer in addition to the dielectric strip. Thus, according to a second aspect of the invention, the dielectric waveguide further comprises an additional dielectric layer disposed in the non-propagating region and/or in the propagating region, the additional dielectric layer having a thickness t and a dielectric constant $\in 3$, wherein the spacings h1 and h2, the dielectric constants $\in 1$, $\in 2$, $\in 3$ and the thickness t are determined to meet the above-mentioned cut-off conditions.

According to a third aspect of the invention, a dielectric waveguide comprises a substantially parallel pair of conductor flat surfaces; and a dielectric member interposed between the pair of conductor flat surfaces, so as to form a propagating region for propagating an electromagnetic wave between the conductor flat surfaces, and a non-propagating region which cuts off the electromagnetic wave. According to the third aspect of the present invention, the spacing h2 between the conductor flat surfaces in the non-propagating region is determined to be smaller than the spacing h1 between the conductor flat surfaces in the propagating region, and the spacings h1 and h2, and the dielectric constant $\in 1$ of the dielectric member are determined to meet the above-mentioned cut-off conditions.

According to a fourth aspect of the present invention, there is provided a dielectric waveguide according to the third aspect, and further comprising an additional dielectric layer disposed in the non-propagating region and/or in the propagating region, the additional dielectric layer having a thickness t and a dielectric constant $\in 3$, wherein the spacings h1 and h2, the dielectric constants $\in 1$, $\in 3$ and the thickness t are determined to meet the above-mentioned cut-off conditions.

According to a fifth aspect of the present invention, there is provided a dielectric waveguide, comprising: a substantially parallel pair of conductor flat surfaces; and a dielectric member interposed between the pair of conductor flat surfaces, so as to form a propagating region for propagating electromagnetic wave between the conductor flat surfaces, and a non-propagating region which cuts off the electromagnetic wave; the dielectric waveguide further comprising first and second dielectric layers continuing from the dielectric member and extending into the non-propagating region and having the dielectric constant $\in 1$, and a third dielectric layer disposed in the non-propagating region between the first and second dielectric layers and having a dielectric constant $\in 2$, and wherein the spacings h1 and h2, the dielectric constants $\in 1$, $\in 2$ and the thickness of the dielectric layer extending into the non-propagating region and having the dielectric constant $\in 1$ are determined to meet the above-mentioned cut-off conditions.

According to a sixth aspect of the present invention, there is provided a dielectric waveguide according to the fifth aspect, and further comprising an additional dielectric layer disposed in the non-propagating region and/or in the propagating region, the additional dielectric layer having a thickness t and a dielectric constant $\in 3$, wherein the spacings h1 and h2, the dielectric constants $\in 1$, $\in 2$, $\in 3$, the thickness t, and the thickness t1 of the dielectric layer extending into the non-propagating region and having the dielectric constant $\in 1$ are determined to meet the above-mentioned cut-off conditions.

In order to make it possible to easily form the propagating region and the non-propagating region, each of the conductor flat surfaces may be formed by covering, with a metallic film, a surface of a dielectric member which is formed by injection molding from a resin or a ceramics material.

According to the structural features of the first to sixth aspects of the invention, the $LSM_{01}$ mode is the mode of the lowest order, so that mode conversion from the $LSM_{01}$ mode to the $LSE_{01}$ mode at a bend, and hence transmission loss attributable to the mode conversion, are eliminated, thus making it possible to design the bend with any desired bend angle and radius of curvature.

These and other objects, features and advantages of the present invention will become clear from the following description of preferred embodiments in conjunction with the accompanying drawings, in which like references correspond respectively to like elements and parts.

BRIEF DESCRIPTION OF THE DRAWINGS

FIGS. 16(A) and 16(B) are illustrations of the relationship between bend angle and transmission loss.

DETAILED DESCRIPTION OF EMBODIMENTS OF THE INVENTION

EXAMPLES

Figure 1:
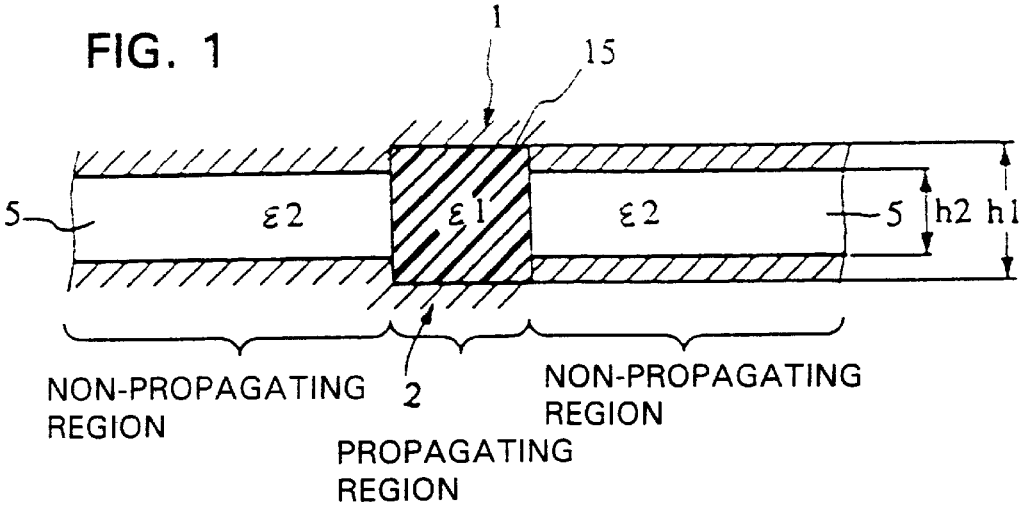
FIG. 1 is a sectional view of a dielectric waveguide in accordance with a first aspect of the present invention.

An example of a dielectric waveguide according to the above-mentioned first aspect of the invention is shown in FIG. 1. Referring to this Figure, numerals 1 and 2 denote conductor flat surfaces. Representing the dielectric constant of a dielectric strip 15 in the propagating region by $\in 1$ and the dielectric constant of a dielectric layer 5 formed in the non-propagating region by $\in 2$, the spacings h1 and h2, and the dielectric constants $\in 1$ and $\in 2$ are determined to meet the above-mentioned cut-off conditions.

Figure 2A:
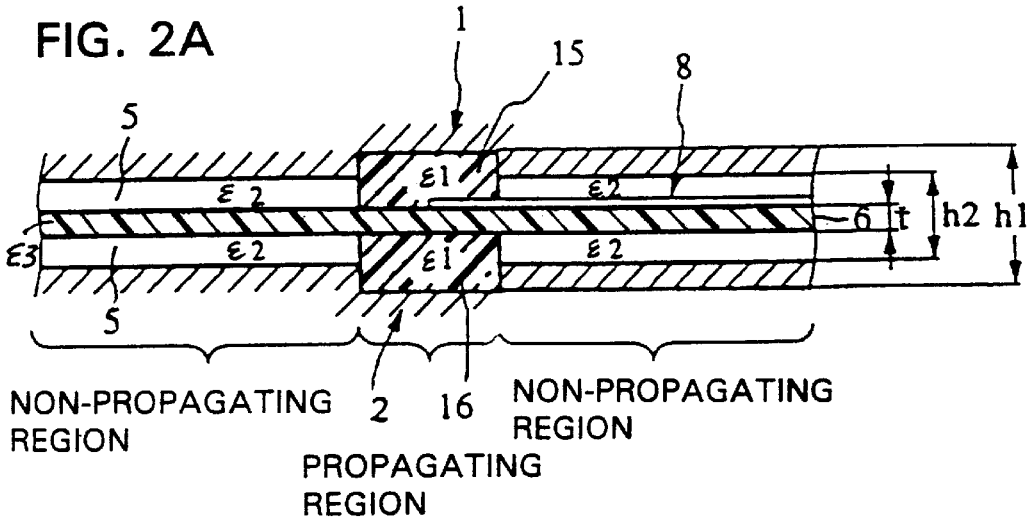
FIGS. 2(A) and 2(B) are sectional views of a dielectric waveguide in accordance with a second aspect of the present invention.
Figure 2B:
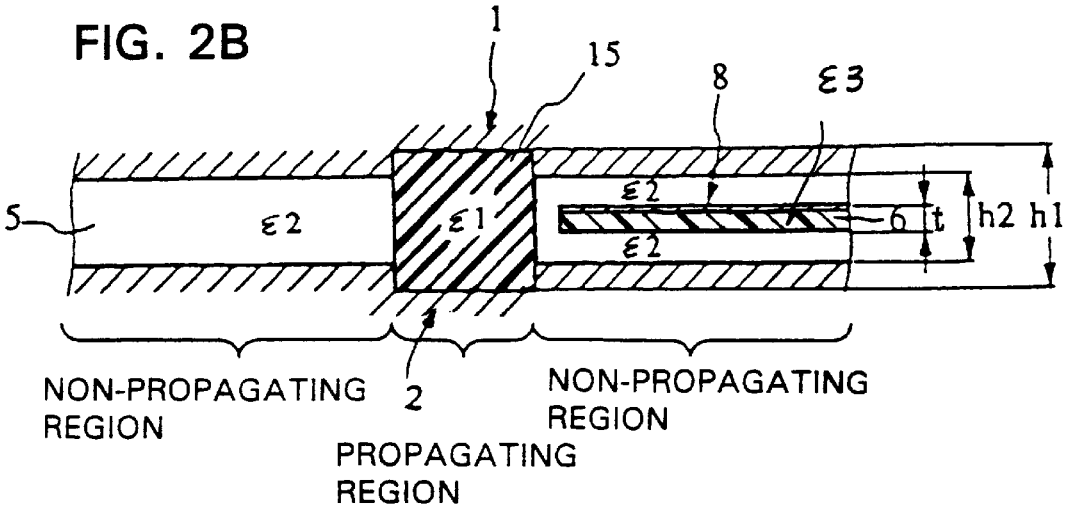

An example of a dielectric waveguide according to the above-mentioned second aspect of the invention is shown in FIGS. 2(A) and 2(B). Referring to these Figures, numeral 6 denotes a dielectric layer which is, for example, a circuit board having a thickness t and a dielectric constant $\in 3$. The arrangement may be such that dielectric strips 15 and 16 each having a dielectric constant $\in 1$ are disposed on the upper and lower sides of the dielectric layer 6 as shown in FIG. 2(A) or, alternatively, such that a dielectric strip is disposed in the same manner as that in FIG. 1 and the dielectric layer 6 is disposed between the conductor flat surfaces 1 and 2 only in the non-propagating region, as shown in FIG. 2(B).

When an additional dielectric layer besides the above-described dielectric strip is disposed between the pair of conductor flat surfaces, as in the case of the above-described arrangements of FIGS. 2(A) and 2(B), a circuit board may be used as such a dielectric layer, and a strip line 8 which is coupled with the electromagnetic field of the $LSM_{01}$ mode may be provided on the circuit board, thus realizing a dielectric waveguide containing a planar circuit.

Figure 3:
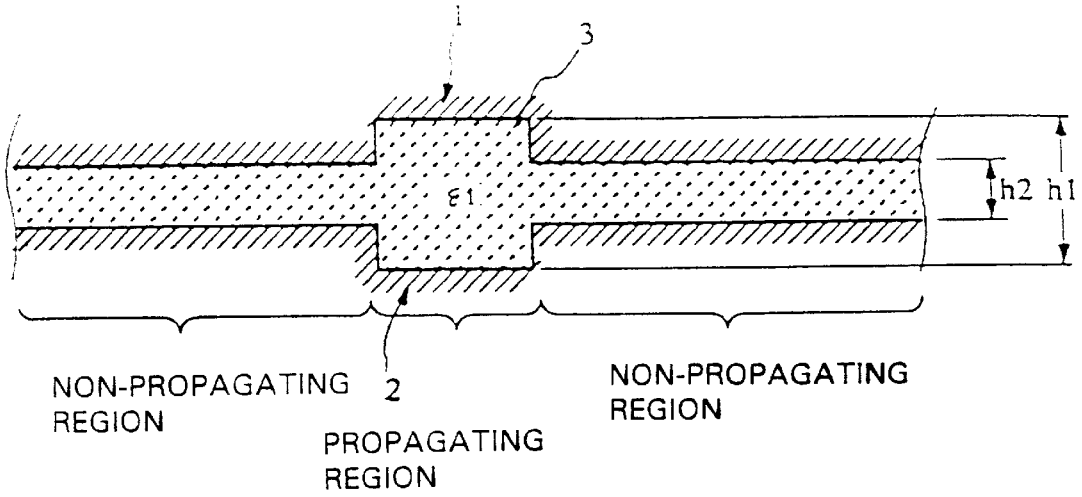
FIG. 3 is a sectional view of a dielectric waveguide in accordance with a third aspect of the present invention.

An example of a dielectric waveguide according to the above-mentioned third aspect of the invention is shown in FIG. 3. As shown in this Figure, the dielectric member 3, having dielectric constant $\in 1$, is disposed between the pair of conductor flat surfaces 1 and 2 so as to extend through both the propagating and the non-propagating regions. The spacings h1 and h2 and the dielectric constant $\in 1$ are determined to meet the above-mentioned cut-off conditions.

Figure 4:
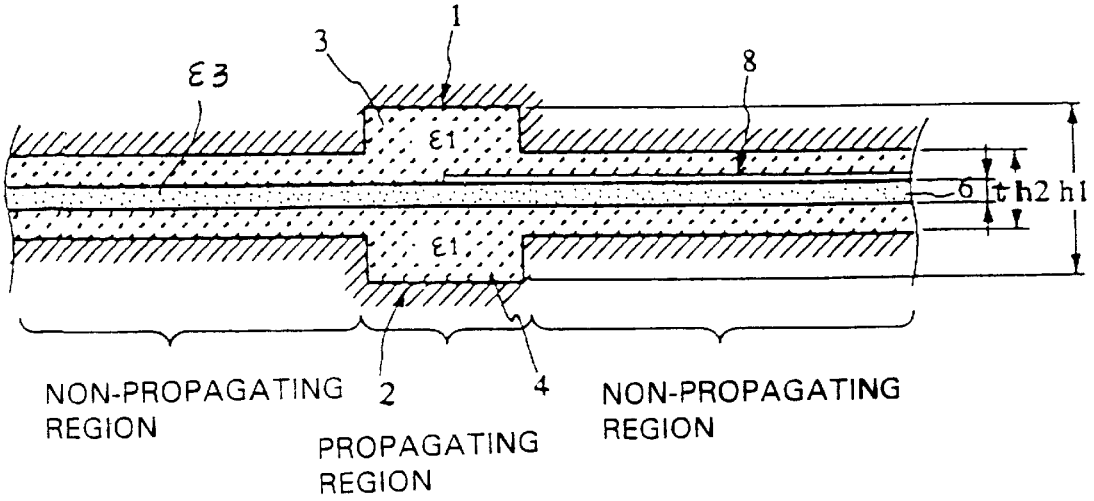
FIG. 4 is a sectional view of a dielectric waveguide in accordance with a fourth aspect of the present invention.

An example of a dielectric waveguide according to the above-mentioned fourth aspect of the invention is shown in FIG. 4. As shown in this Figure, dielectric members 3, 4 having dielectric constant $\in 1$ are disposed between the pair of conductor flat surfaces 1 and 2 so as to extend through the propagating and the non-propagating regions. The dielectric members 3, 4 may advantageously have a thickness t. In addition, a dielectric layer 6 having a thickness t and a dielectric constant $\in 3$ is provided in the non-propagating region and/or in the propagating region. The spacings h1 and h2, the dielectric constants $\in 1$, $\in 3$ and the thickness t are determined to meet the above-mentioned cut-off conditions.

Figure 5:
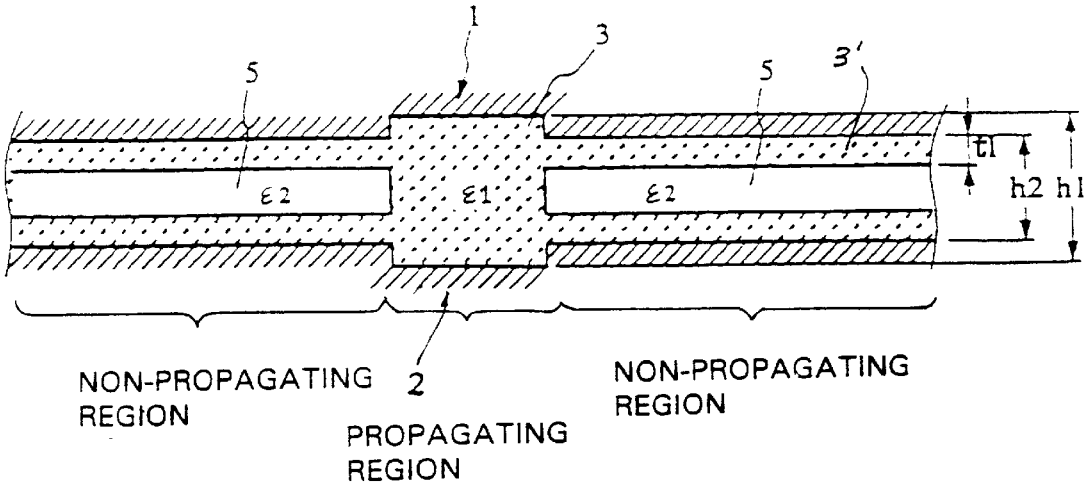
FIG. 5 is a sectional view of a dielectric waveguide in accordance with a fifth aspect of the present invention.

An example of a dielectric waveguide according to the above-mentioned fifth aspect of the invention is shown in FIG. 5. As shown in this Figure, a dielectric layer 3' having a thickness t1 and a dielectric constant $\in 1$ and another dielectric layer 5 having a dielectric constant $\in 2$ are disposed between the pair of conductor flat surfaces 1 and 2 so as to extend from the propagating region and through the non-propagating region. The spacings h1 and h2, the dielectric constant $\in 1$, $\in 2$ and the thickness t1 are determined to meet the above-mentioned cut-off conditions.

Figure 6:
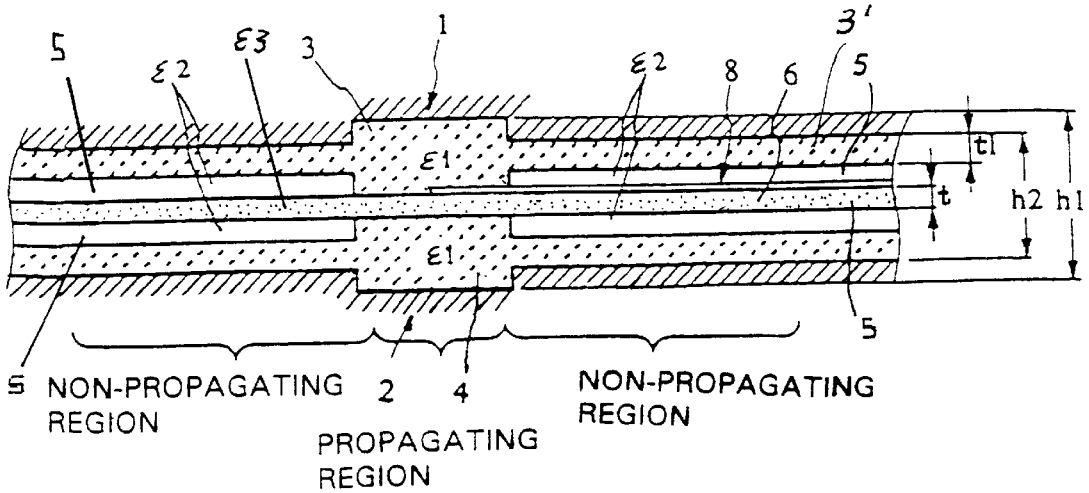
FIG. 6 is a sectional view of a dielectric waveguide in accordance with a sixth aspect of the present invention.
Figure 7A:
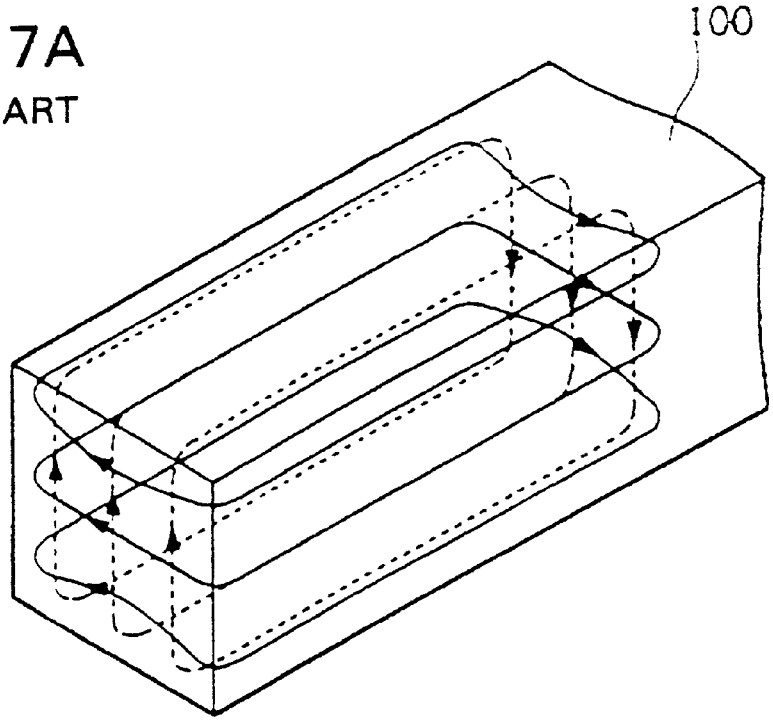
FIG. 7A PRIOR ART
FIGS. 7(A) and 7(B) are illustrations of electromagnetic wave distributions in the $LSM_{01}$ mode and the $LSE_{01}$ mode, respectively.
Figure 7B:
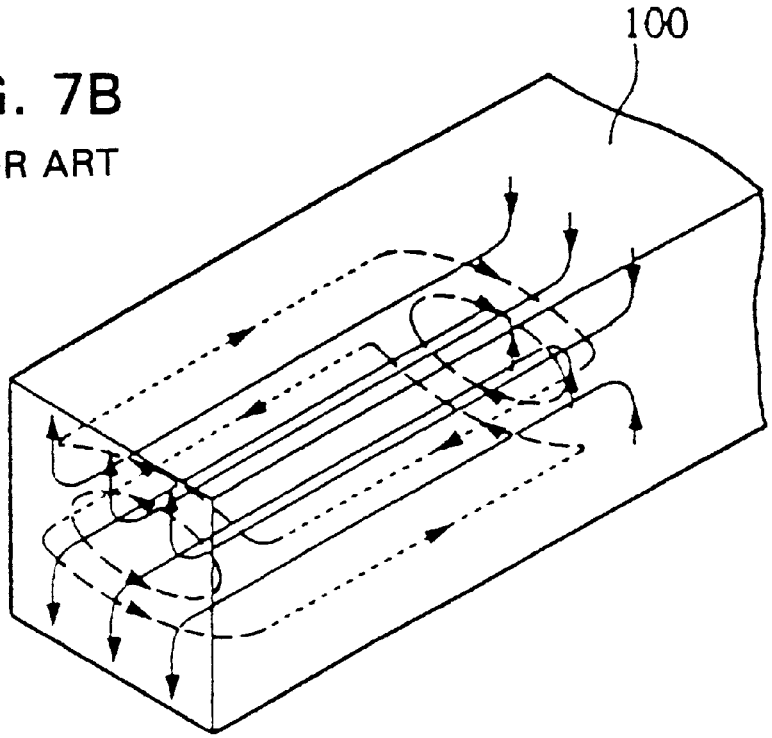
FIG. 7B PRIOR ART

An example of a dielectric waveguide according to the above-mentioned sixth aspect of the invention is shown in FIG. 6. As shown in this Figure, a dielectric layer 3' having a thickness t1 and a dielectric constant ∈1 and another dielectric layer 5 having a dielectric constant ∈2 are disposed between the pair of conductor flat surfaces 1 and 2 so as to extend from the propagating region and through the non-propagating region. An additional dielectric layer 6 having a thickness t and a dielectric constant ∈3 is also provided. The spacings h1 and h2, the dielectric constant ∈1, ∈2, ∈3 and the thicknesses t and t1 are determined to meet the above-mentioned cut-off conditions.

First Embodiment

The construction of a dielectric waveguide in accordance with a first embodiment of the present invention will be described with specific reference to FIGS. 10(A) to 16(B).

Figure 13:
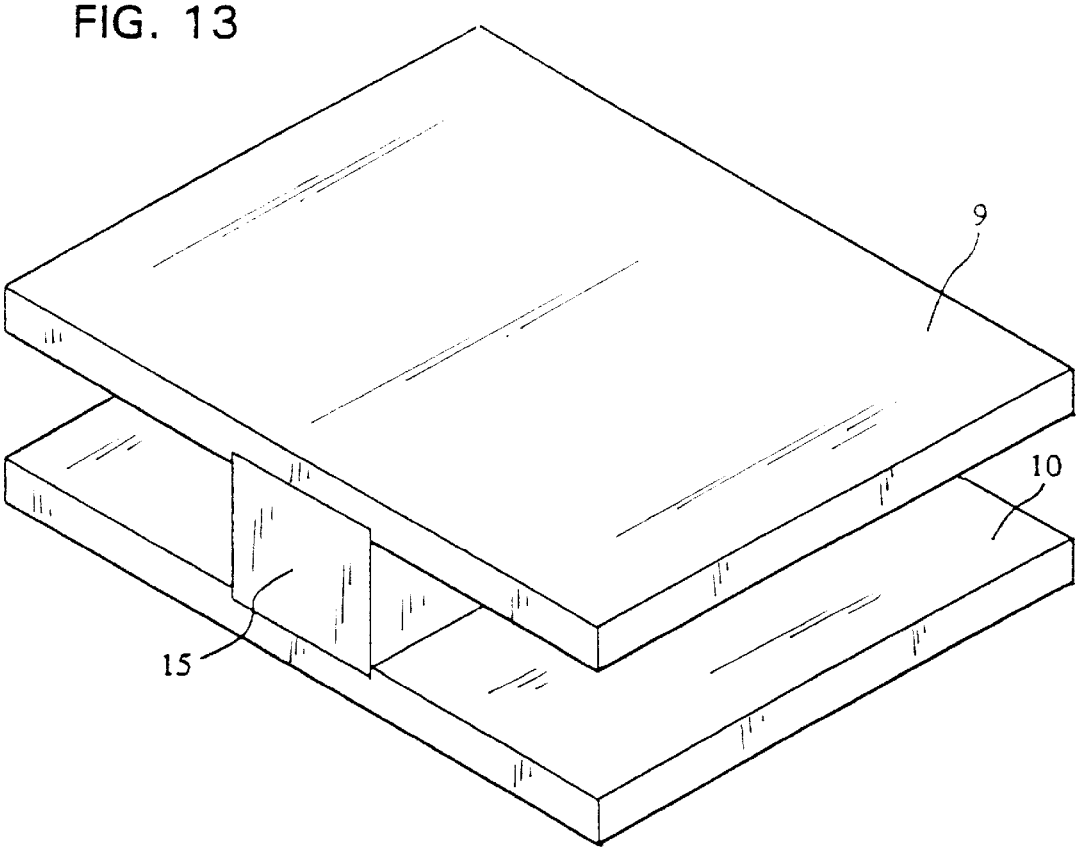
FIG. 13 is a perspective view of a dielectric waveguide in accordance with the first embodiment of the present invention.
Figure 14:
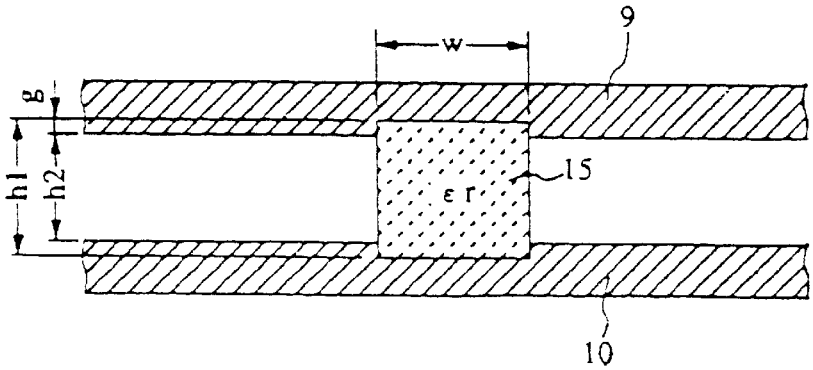
FIG. 14 is a sectional view of a dielectric waveguide in accordance with the first embodiment of the present invention.

FIG. 13 is a perspective view of the dielectric waveguide in accordance with the first embodiment of the present invention. The dielectric waveguide has, as illustrated, metallic flat plates 9 and 10 which present conductor flat surfaces, and a dielectric strip 15. The arrangement is such that the dielectric strip 15 fits in grooves which are formed in opposing surfaces of the metallic flat plates 9, 10. FIG. 14 is a sectional view of the dielectric waveguide shown in FIG. 13. Referring to this Figure, the dielectric strip 15 has a relative dielectric constant, indicated by ∈r, a width w and a height h1. The height difference or distance between the metallic flat plates 9, 10 in the non-propagating region is indicated by h2, while the groove depth is indicated by g. In order that the electromagnetic wave at the frequency of use is cut-off in the non-propagation region, the above-mentioned height difference h2, which is given by h2=h1−g, is determined to meet the condition $h2<\lambda_0/2$, where λ0 indicates the wavelength of the wave at the frequency of use in free space.

FIGS. 10(A), 10(B), FIGS. 11(A), 11(B) and FIGS. 12(A), 12(B) show characteristics of dielectric waveguides which are constructed in accordance with the first embodiment and which employ different values of the parameters shown in FIG. 14. In each pair of the Figures, the respective Figure with suffix B shows a corresponding calculation model, while the respective Figure with suffix A shows a corresponding dispersion curve obtained through calculation conducted by using the calculation model, with the axes of abscissa and ordinate representing the frequency and the phase constant β, respectively. In each case, the dielectric constant ∈1 of the air layer is 1.0.

Figure 10A:
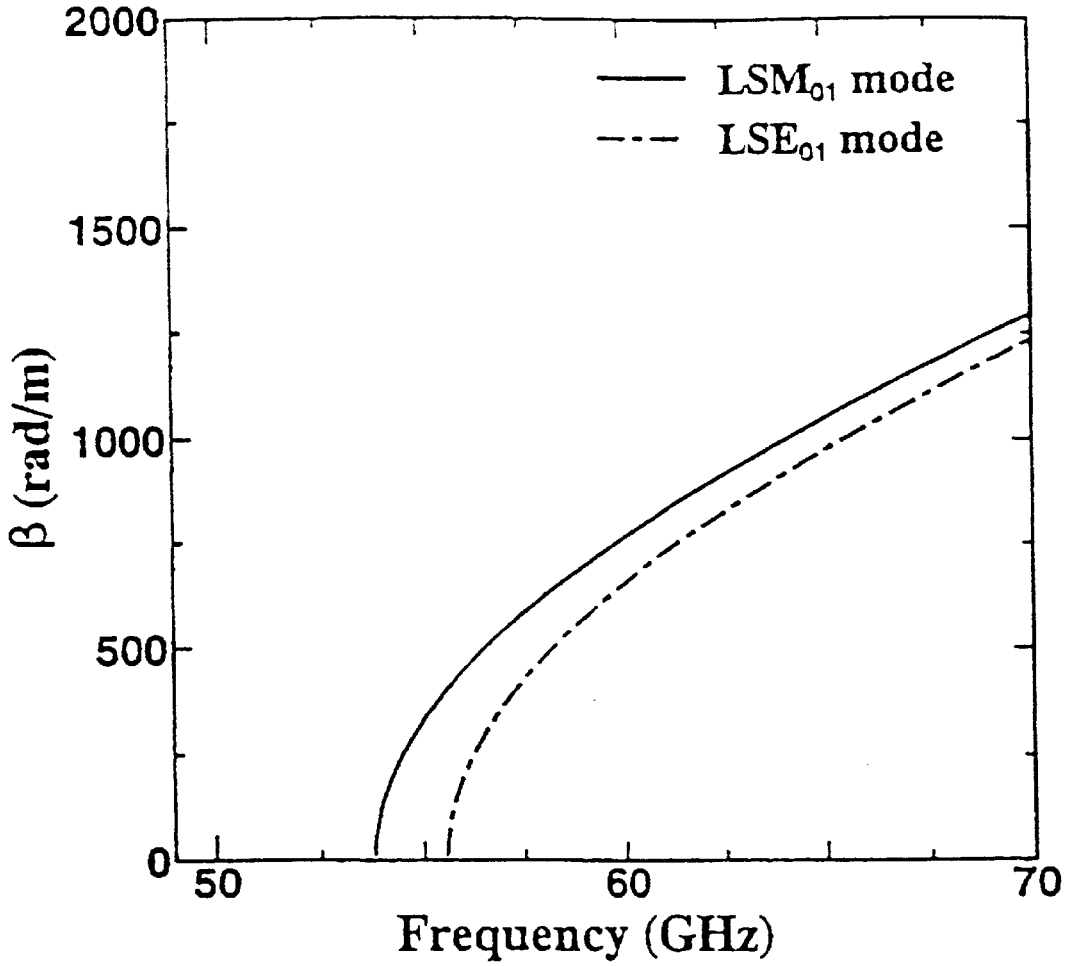
FIGS. 10(A) and 10(B) show, respectively, a dispersion curve as observed with a dielectric waveguide in accordance with a first embodiment of the invention and a calculation model for the same dielectric waveguide.
Figure 10B:
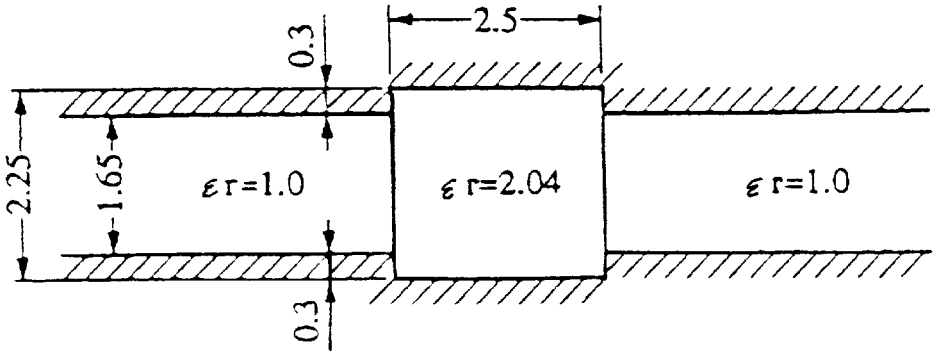

FIGS. 10(A) and 10(B) respectively show the dispersion curve and the calculation model of the dielectric waveguide which is obtained by using the following parameter values: ∈r=2.04, w=2.5 mm, h1=2.25 mm, h2=1.65 mm and g=0.3 mm. In this case, the propagation of the $LSM_{01}$ mode takes place at frequencies not lower than 53.8 GHz, while propagation of the $LSE_{01}$ mode occurs at frequencies not lower than 55.6 GHz, so that only the $LSM_{01}$ mode propagates in the frequency band of from 53.8 GHz to 55.6 GHz.

Figure 11A:
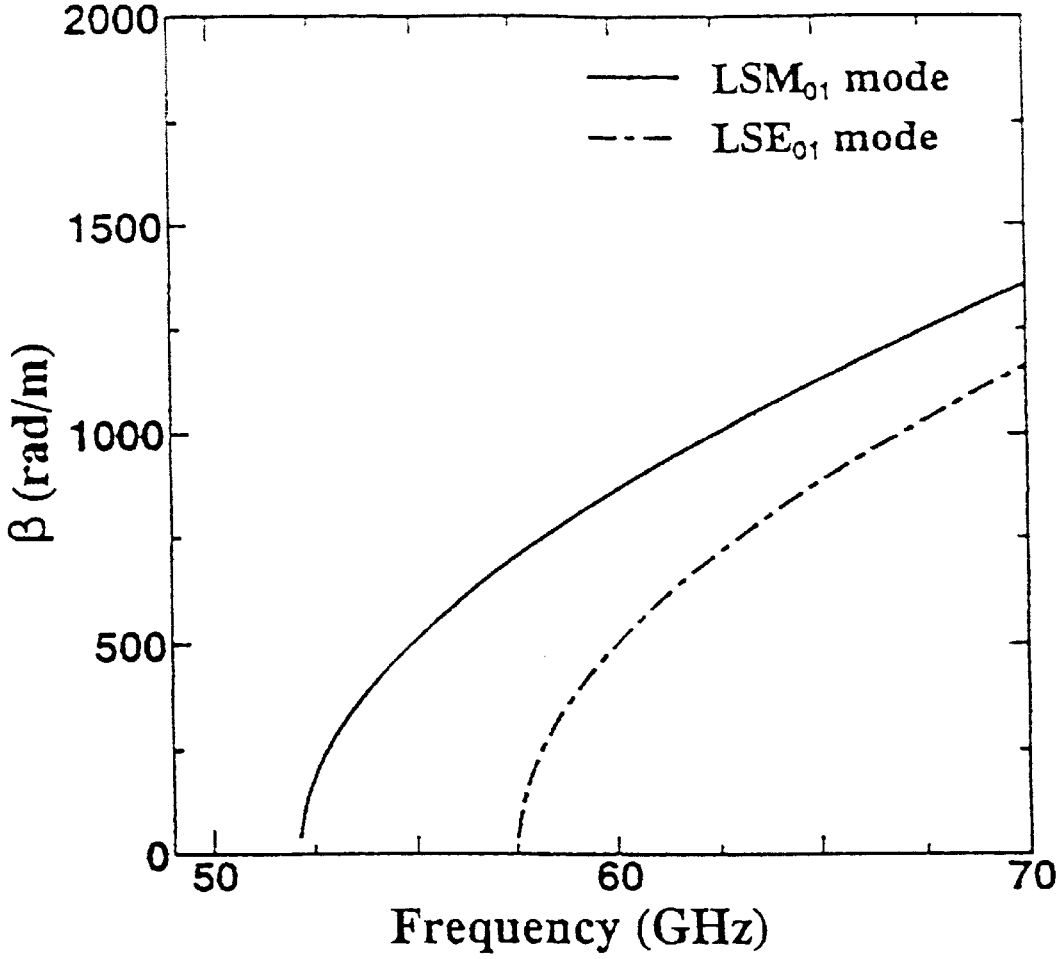
FIGS. 11(A) and 11(B) show, respectively, a dispersion curve as observed with a dielectric waveguide in accordance with the first embodiment employing different values of parameters and a calculation model for the same dielectric waveguide.
Figure 11B:
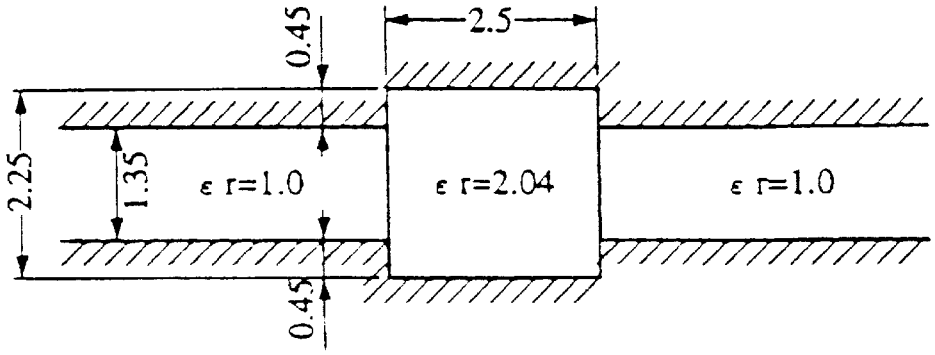

FIGS. 11(A) and 11(B) respectively show the dispersion curve and the calculation model of the dielectric waveguide which is obtained by using the following parameter values: ∈r=2.04, w=2.5 mm, h1=2.25 mm, h2=1.35 mm and g=0.45 mm. In this case, the propagation of the $LSM_{01}$ mode takes place at frequencies not lower than 52.1 GHz, while propagation of the $LSE_{01}$ mode occurs at frequencies not lower than 57.5 GHz, so that only the $LSM_{01}$ mode propagates in the frequency band of from 52.1 GHz to 57.5 GHz.

Figure 12A:
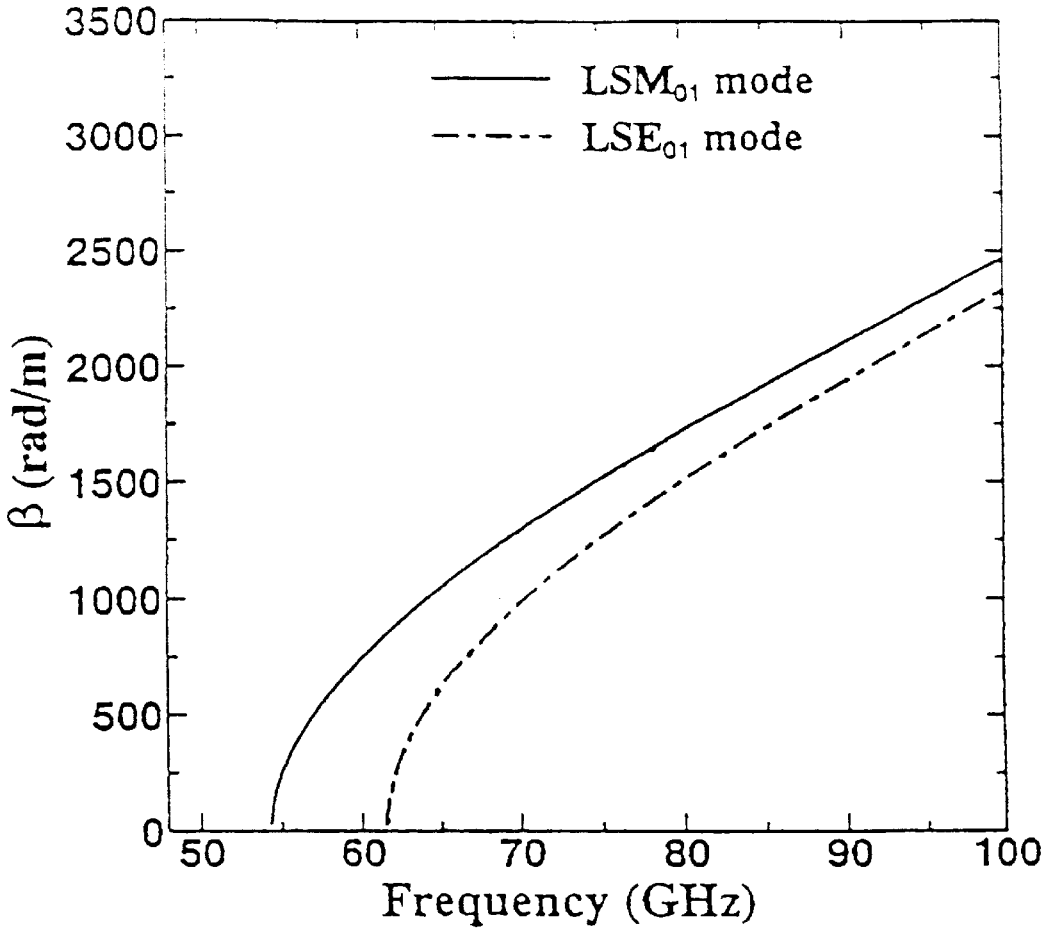
FIGS. 12(A) and 12(B) show, respectively, a dispersion curve as observed with a dielectric waveguide in accordance with the first embodiment employing different values of parameters and a calculation model for the same dielectric waveguide.
Figure 12B:
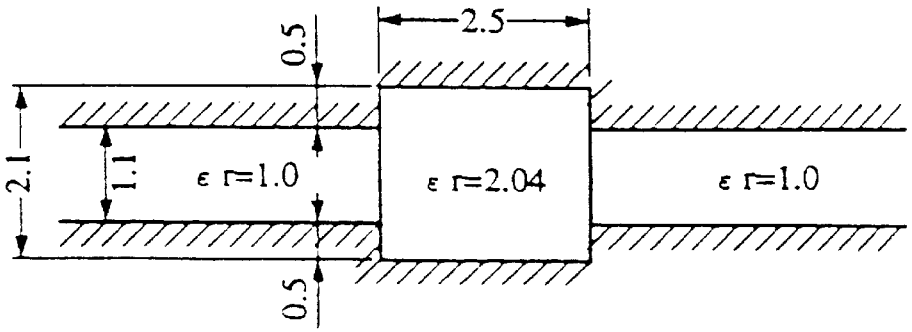

FIGS. 12(A) and 12(B) respectively show the dispersion curve and the calculation model of the dielectric waveguide which is obtained by using the following parameter values: ∈r=2.04, w=2.5 mm, h1=2.1 mm, h2=1.1 mm and g=0.5 mm. In this case, the propagation of the $LSM_{01}$ mode takes place at frequencies not lower than 54.3 GHz, while propagation of the $LSE_{01}$ mode occurs at frequencies not lower than 61.5 GHz, so that only the $LSM_{01}$ mode propagates in the frequency band of from 54.3 GHz to 61.5 GHz.

Figure 15:
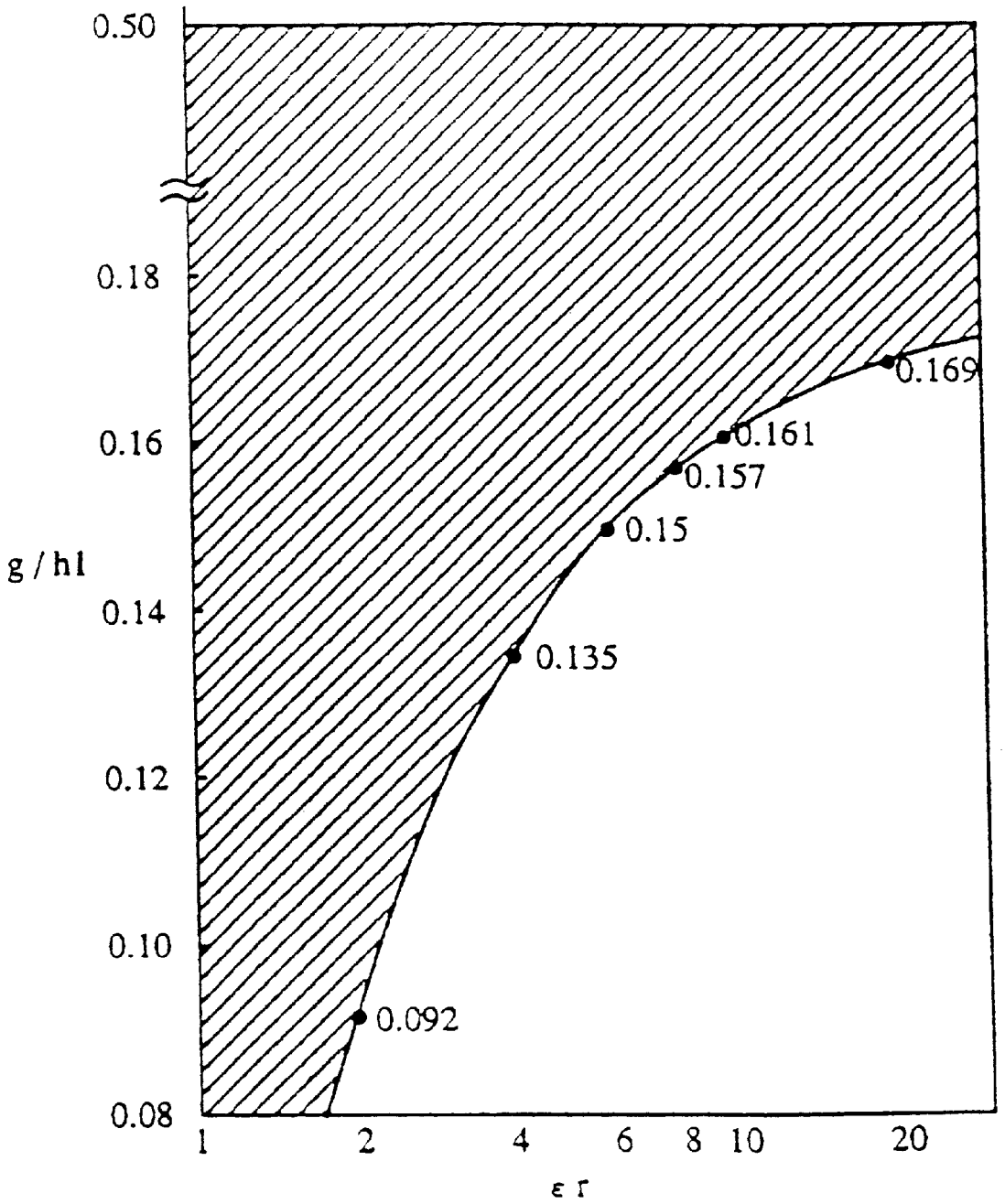
FIG. 15 is an illustration of a range of combinations of the dielectric constant of a dielectric strip and the depth of a groove.

Dispersion curves were obtained by varying values of the parameters ∈r and g/h1, while setting the width w to an arbitrary value, in order to find the conditions for making the $LSM_{01}$ mode the mode of the lowest order, the results being shown in FIG. 15. The hatched area in FIG. 15 shows the range in which the $LSM_{01}$ mode becomes the mode of the lowest order. For instance, when the value of the dielectric constant ∈r is 2 (∈r=2), the $LSM_{01}$ mode as the mode of the lowest order is obtained on condition that the factor g/h1 is not smaller than 0.092. Likewise, the condition for obtaining the $LSM_{01}$ mode as the mode of the lowest order is that the factor g/h1 is 0.135 or greater, when the value of the dielectric constant ∈r is 4 (∈r=4). Thus, the $LSM_{01}$ mode alone is propagated even at the bent portion, when the conditions fall within the hatched area in FIG. 15. It is to be noted, however, the condition of g/h1=0.5, i.e., the topmost line defining the upper limit of the hatched area in FIG. 15, is excluded.

Figure 8A:
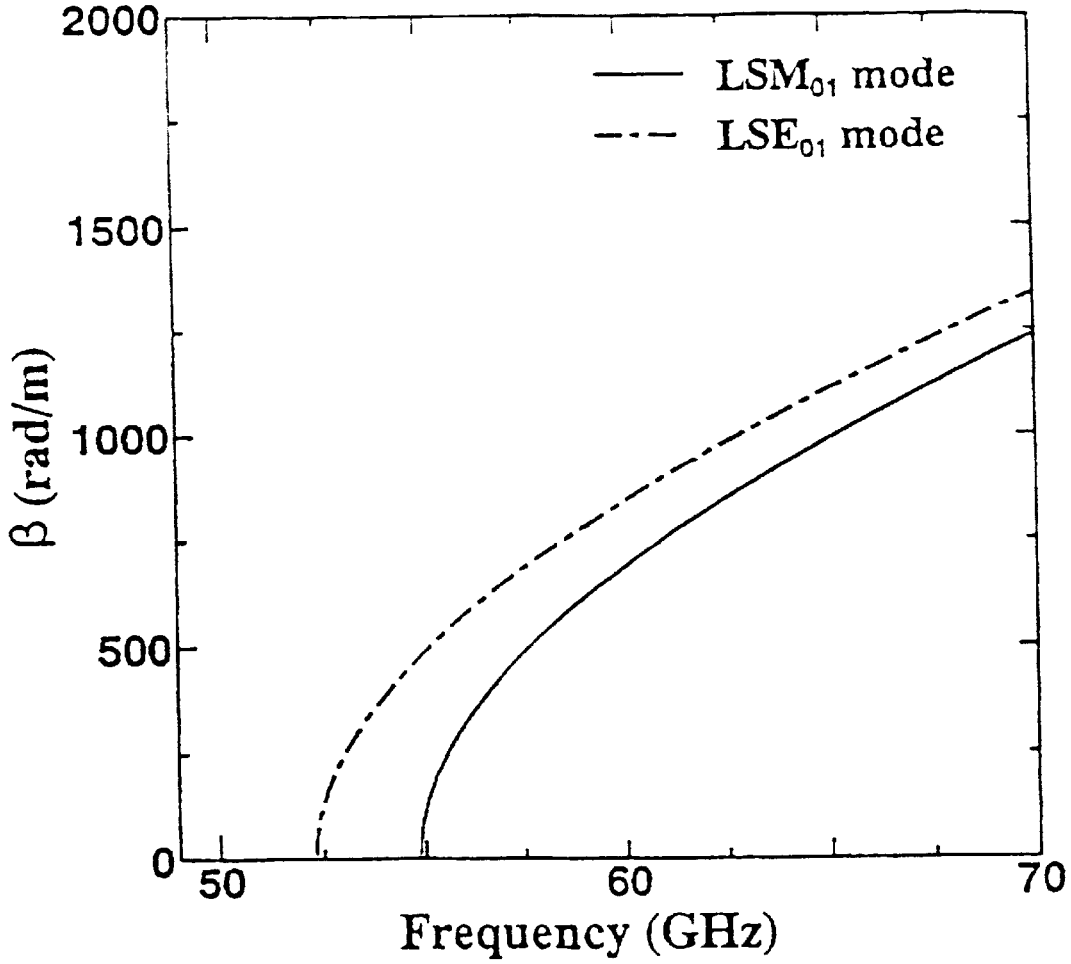
FIG. 8A PRIOR ART
FIGS. 8(A) and 8(B) show, respectively, a dispersion curve as observed with a conventional normal-type dielectric waveguide and a calculation model for the same dielectric waveguide.
Figure 8B:
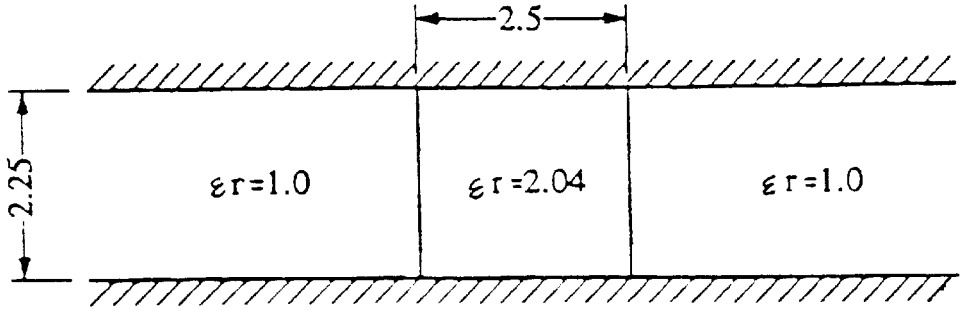
FIG. 8B PRIOR ART
Figure 9A:
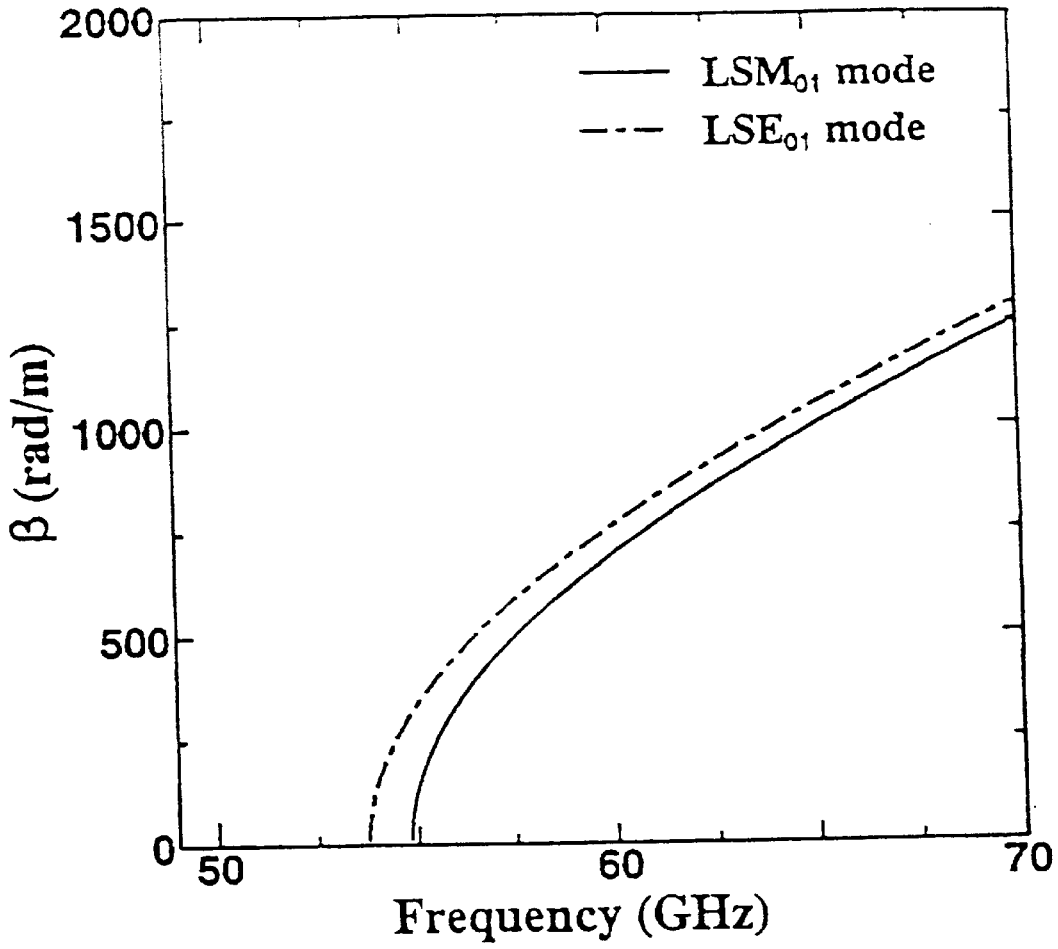
FIG. 9A PRIOR ART
FIGS. 9(A) and 9(B) show, respectively, a dispersion curve as observed with a conventional grooved-type dielectric waveguide and a calculation model for the same dielectric waveguide.
Figure 9B:
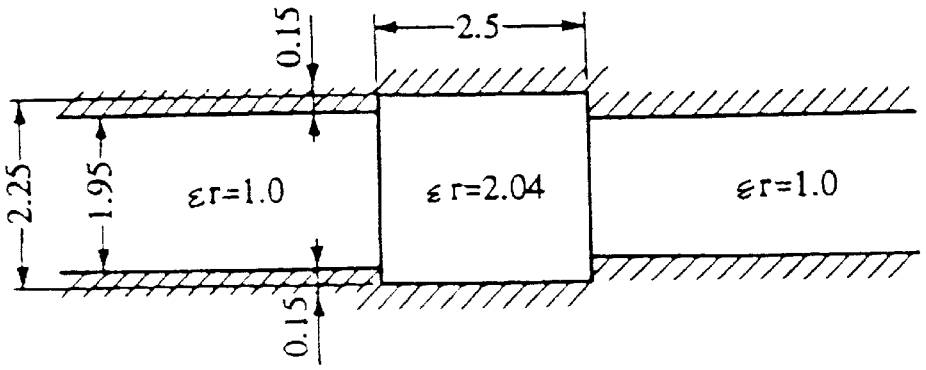
FIG. 9B PRIOR ART

FIG. 16(A) shows the relationship between the bend angle θ of a bend shown in FIG. 16(B) and the transmission loss, obtained when the radius R of curvature of the bend and the frequency are set to 9.6 mm and 60 GHz, respectively, as observed in the dielectric waveguide of the first embodiment, in comparison with the relationship as observed in a conventional dielectric waveguide. More specifically, the broken-line curve in FIG. 16(A) shows the characteristic determined through calculation conducted by means of the calculation model shown in FIG. 8(B), while the solid line shows the characteristic obtained through calculation using the calculation model shown in FIG. 12(B). It will be seen that the conventional waveguide exhibits transmission loss which varies over a wide range of between 0 and about 4 dB in accordance with a change in the bend angle θ. For instance, the transmission loss is as large as 4 dB when the angle θ is set to be θ=75°. In contrast, in the bend of the dielectric waveguide embodying the present invention, the loss is constantly held to be 0 (zero), irrespective of the bend angle θ. The above-mentioned transmission loss is the loss which occurs due to the presence of the bend, i.e., the loss in a virtual non-loss system which disregards the loss in the dielectric portion and in the conductor portion of the waveguide.

Second Embodiment

Figure 17A:
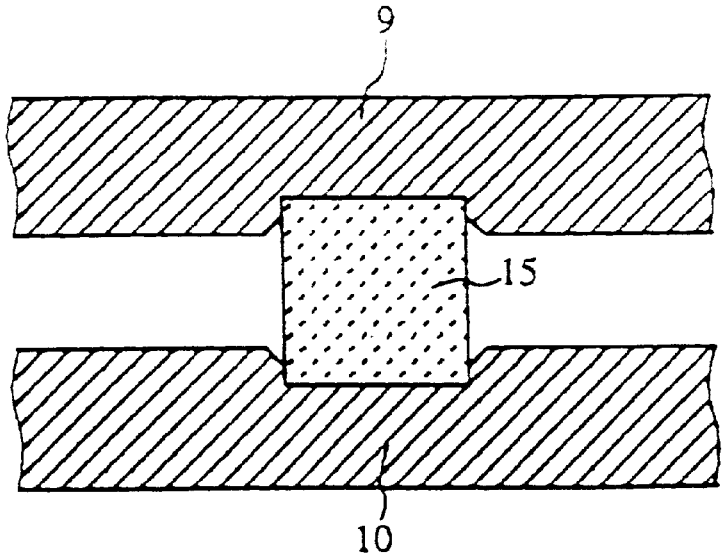
FIGS. 17(A) and 17(B) are sectional views of a dielectric waveguide in accordance with a second embodiment of the present invention.
Figure 17B:
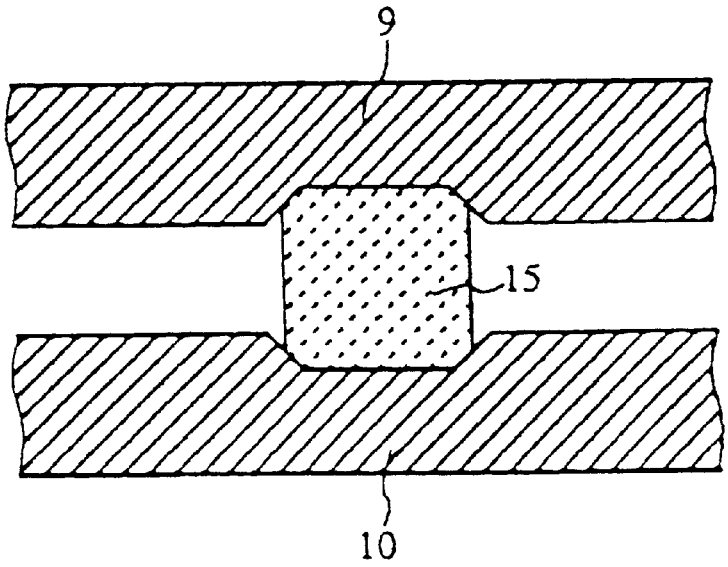

Two types of dielectric waveguide, both constructed in accordance with a second embodiment of the present invention, are shown in sectional views in FIGS. 17(A) and 17(B), respectively. The dielectric waveguides of the second embodiment are distinguished from the dielectric waveguide of the first embodiment shown in FIGS. 13 and 14 in that the edges of walls of the grooves formed in the metallic flat plates 9, 10 are tapered. In particular, in the waveguide shown in FIG. 17(B), the corners of the dielectric strip 15 are chamfered in conformity with the tapers of the walls of the grooves formed in the metallic flat plates 9 and 10. The structures shown in FIGS. 17(A) and 17(B) facilitate fitting the dielectric strip into the grooves formed in the metallic flat plates, while securing the dielectric waveguide against any positional offset.

Figure 18:
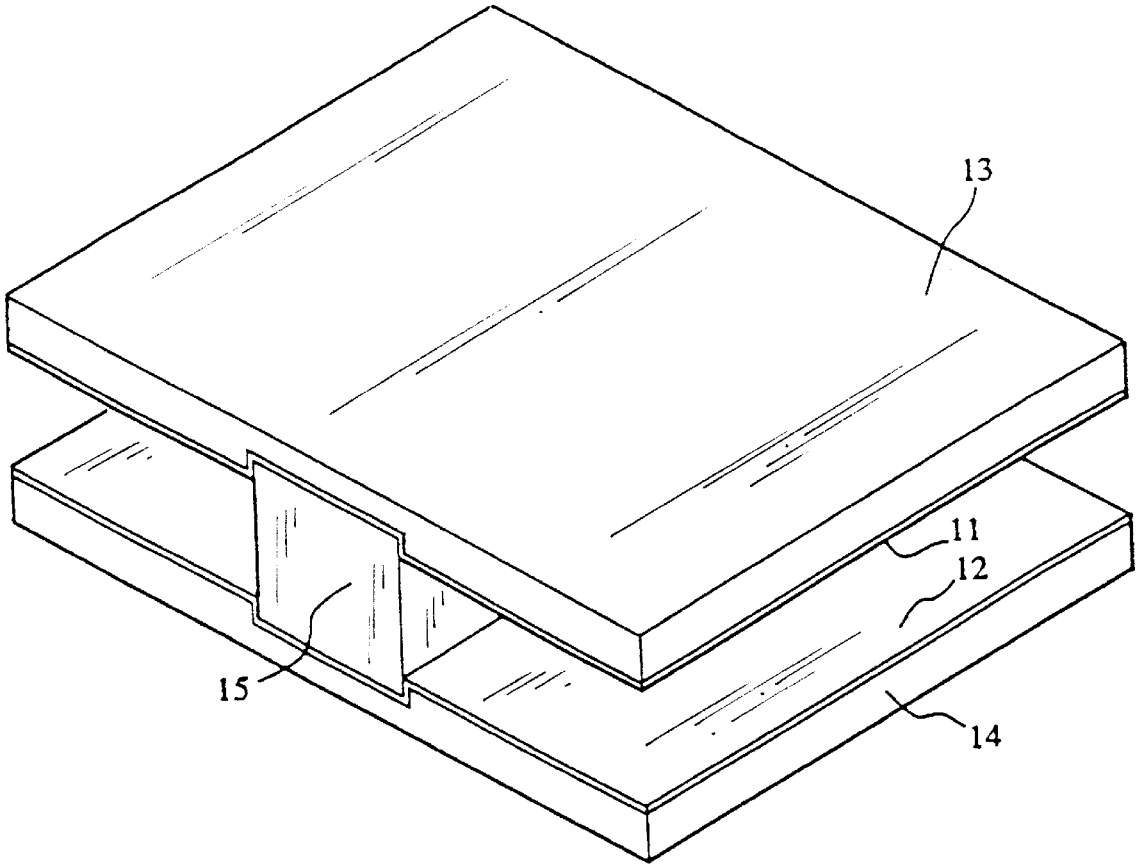
FIG. 18 is a perspective view of a dielectric waveguide in accordance with a third embodiment of the present invention.

FIG. 18 is a perspective view of a dielectric waveguide constructed in accordance with a third embodiment of the present invention. In this Figure, numerals 13 and 14 denote plates injection-molded from a synthetic resin or a ceramics material. These plates 13 and 14 are respectively covered at their opposing surfaces with conductive films 11 and 12 which present conductor flat surfaces.

Figure 19A:
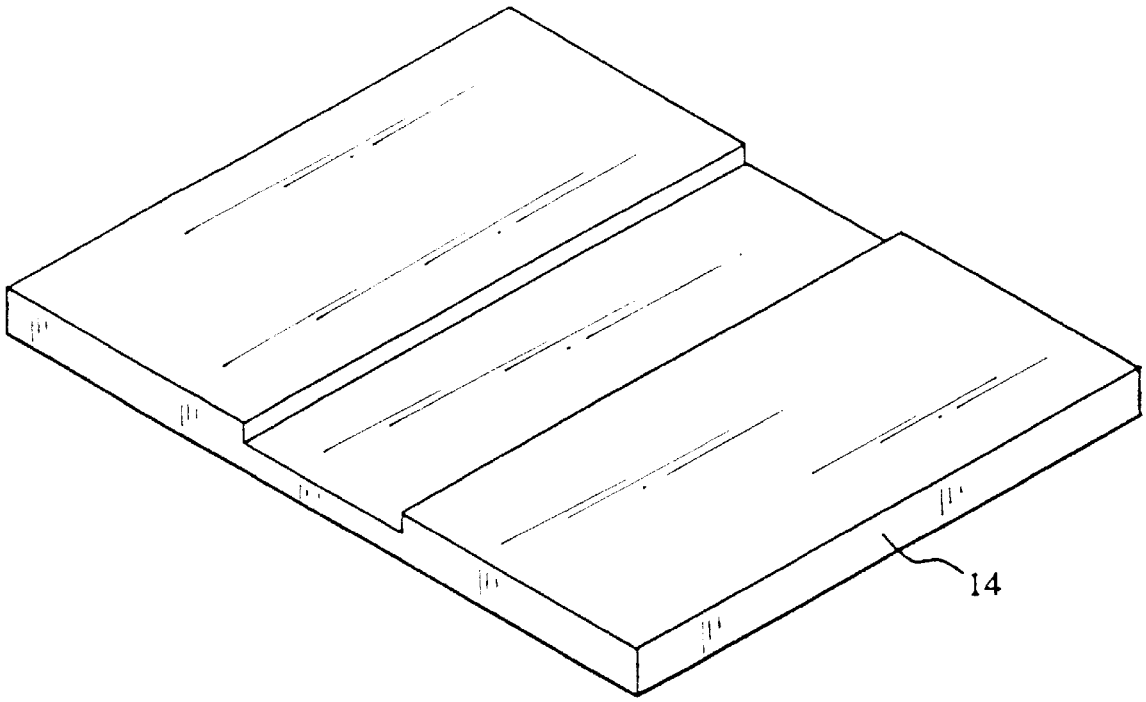
FIGS. 19(A) and 19(B) illustrate, in perspective views, a process for fabricating a dielectric waveguide in accordance with the third embodiment of the present invention.
Figure 19B:
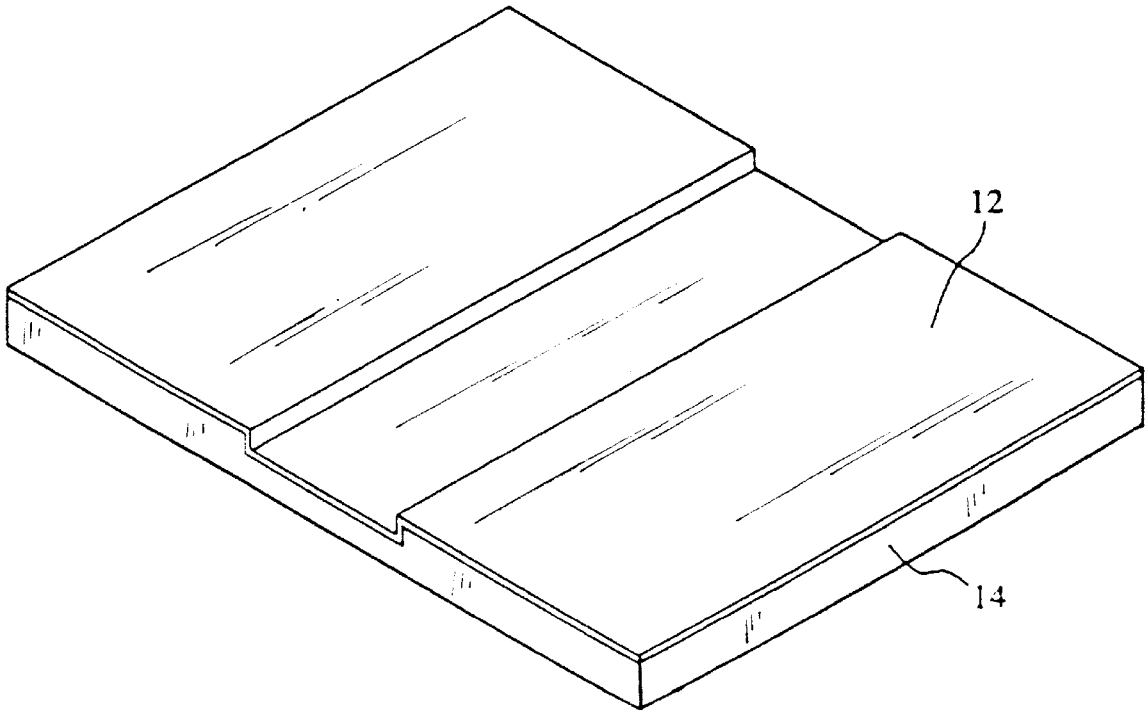

FIGS. 19(A) and 19(B) are perspective views of a component of the dielectric waveguide shown in FIG. 18, illustrative of a process for forming the molded plate 14 and the conductive film 12. The plate 14 (see FIG. 19(A)) is formed by injection molding so as to have a groove for receiving the dielectric strip, and the conductive film 12 of silver, copper or the like is formed on the grooved surface of the plate 14 by plating, as shown in FIG. 19(B). The other plate 13 with the conductive film 11 is prepared by the same process. Then, both plates 13, 14 are brought together so as to sandwich the dielectric strip 15 therebetween such that the dielectric strip 15 is partly received in the grooves formed in the opposing surfaces of the plates 13, 14. This process including injection molding and the subsequent formation of the conductive film improves the production efficiency. A highly reliable dielectric waveguide which is stable both electrically and mechanically against the environment can be obtained when the plates are molded from a synthetic resin or a ceramics material having thermal expansion coefficient equal to or approximating that of the dielectric strip.

Figure 20:
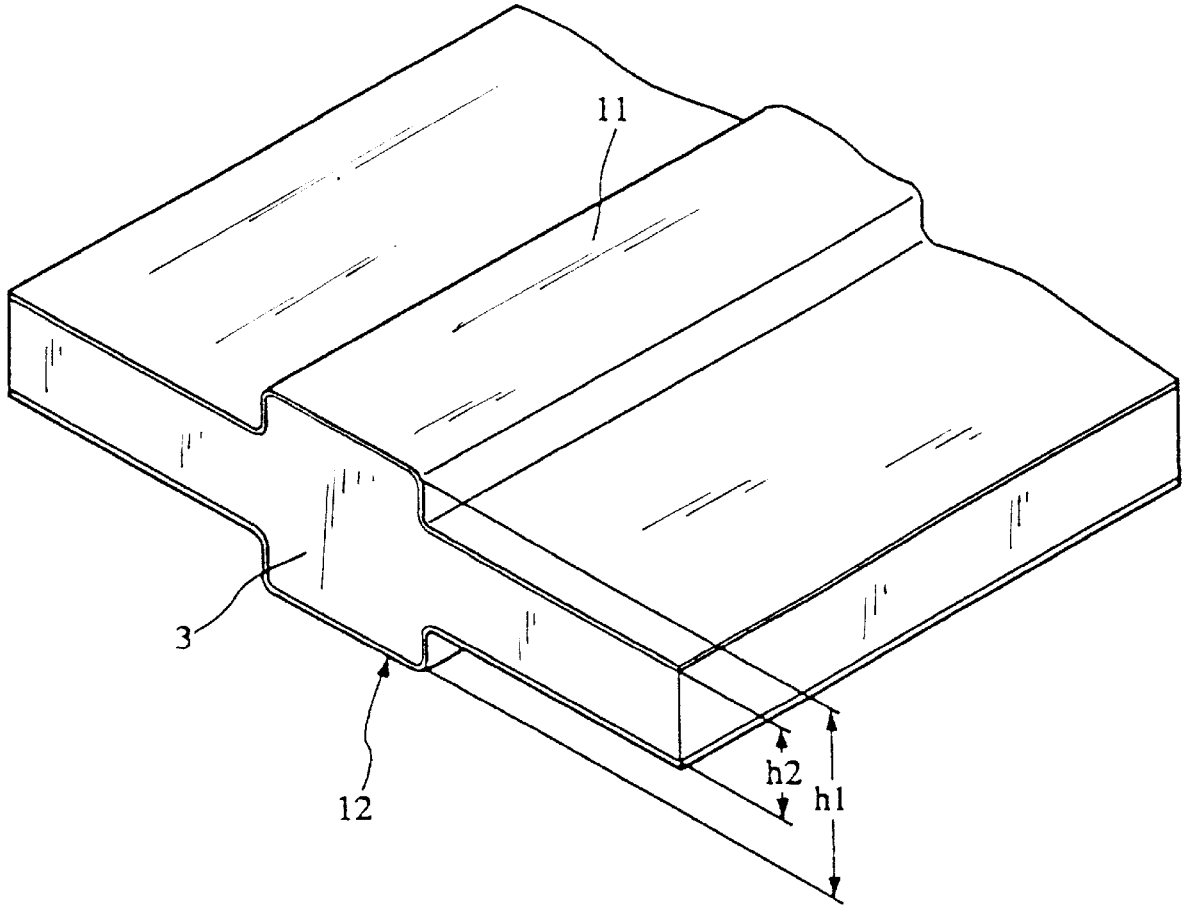
FIG. 20 is a perspective view of a dielectric waveguide in accordance with a fourth embodiment of the present invention.

FIG. 20 is a perspective view of a dielectric waveguide in accordance with a fourth embodiment of the present invention. Referring to this Figure, numeral 3 denotes an integral molded member which is made of a dielectric ceramics material or a resin and which is covered at its upper and lower surfaces with conductive films 11 and 12 over the entire areas of these surfaces. The dielectric member 3 has a thick-walled portion at which it protrudes up and down, thus presenting an increased thickness or height h1, relative to the level of the remaining portions having a smaller thickness or height h2. The heights h1 and h2 are determined so as to meet the conditions $h1>\lambda d/2$ and $h2<\lambda d/2$, where $\lambda d$ represents the wavelength of the wave at the frequency of use propagating through the dielectric member, so that the portion of the dielectric member 3 having the increased height h1 serves as the propagating region, while the remaining portions having the smaller height h2 provide non-propagating regions. The heights h1 and h2, as well as the dielectric constant $\in 1$ of the dielectric member 3, are determined such that the cut-off frequency of the $LSM_{01}$ mode falls below that of the $LSE_{01}$ mode and such that the frequency in use ranges between the cut-off frequency of the $LSE_{01}$ mode and that of the $LSM_{01}$ mode.

Figure 21:
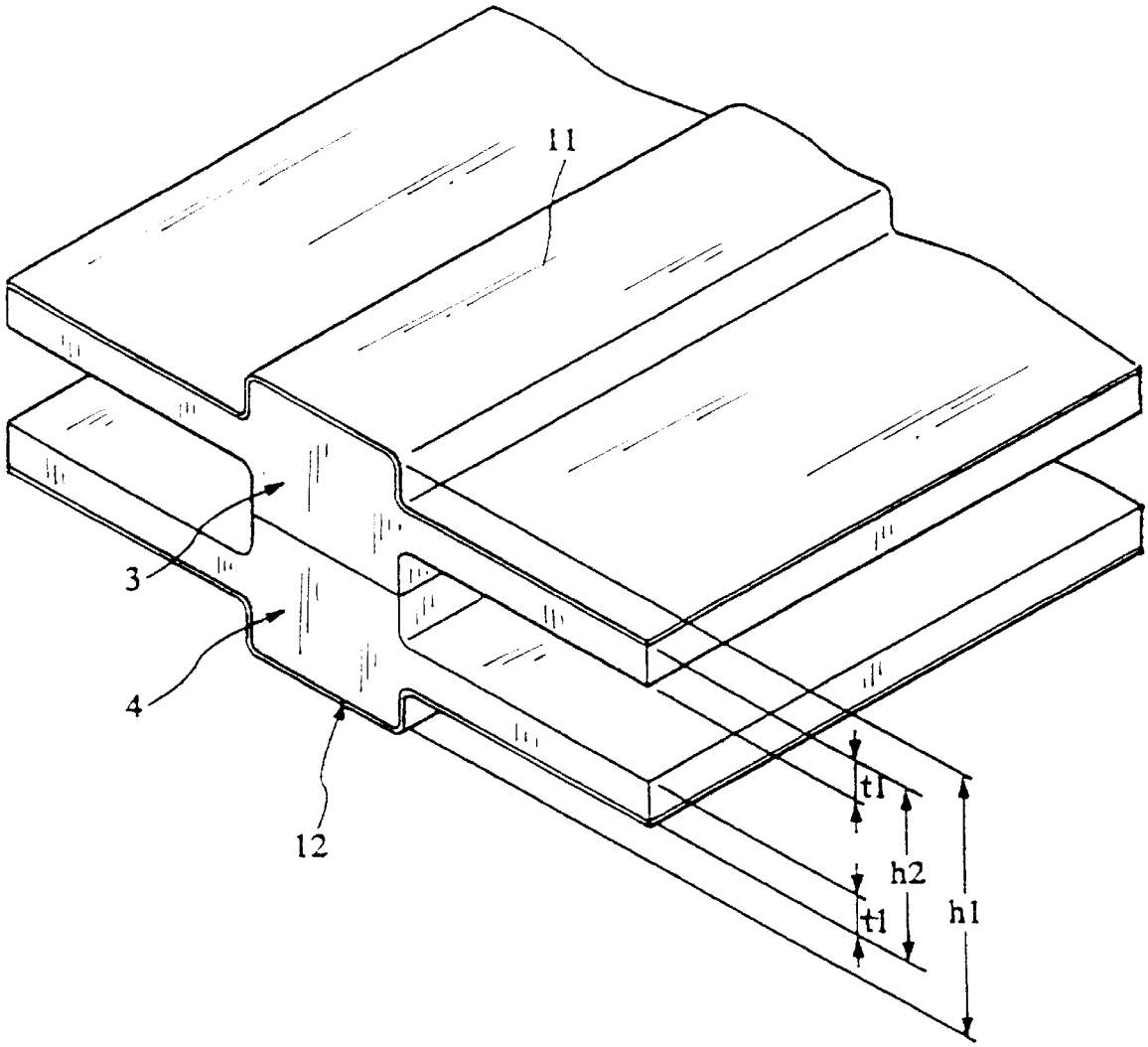
FIG. 21 is a perspective view of a dielectric waveguide in accordance with a fifth embodiment of the present invention.

FIG. 21 is a perspective view of a dielectric waveguide in accordance with a fifth embodiment of the present invention. Referring to this Figure, numerals 3 and 4 denote dielectric members molded from a dielectric ceramics material or a resin. The dielectric member 3 is covered at its upper surface with a conductive film 11, while the dielectric member 4 is covered at its lower surface with a conductive film 12, over the entire areas of these surfaces. Each of the dielectric members 3, 4 has a thick-walled portion and they are joined together at their thick-walled portions so as to form the dielectric waveguide. Thus, the whole dielectric waveguide has a thick portion having a thickness or height h1 and other portions of a smaller thickness or height h2. The heights h1 and h2 are determined such as to meet the conditions of $h1>\lambda d/2$ and $h2<\lambda 0/2$, where $\lambda d$ represents the wavelength of the wave at the frequency of use propagating through the dielectric member and $\lambda 0$ represents the wavelength of the wave of the used frequency in free space, so that the portion having the increased height h1 serves as the propagating region, while the remaining portions having the smaller height h2 provide non-propagating regions. The heights h1 and h2 and the thickness t1 of each dielectric member 3, 4, as well as the dielectric constant $\in 1$ of the dielectric members 3, 4, are determined such that the cut-off frequency of the $LSM_{01}$ mode falls below that of the $LSE_{01}$ mode and such that the frequency in use ranges between the cut-off frequency of the $LSE_{01}$ mode and that of the $LSM_{01}$ mode.

Figure 22A:
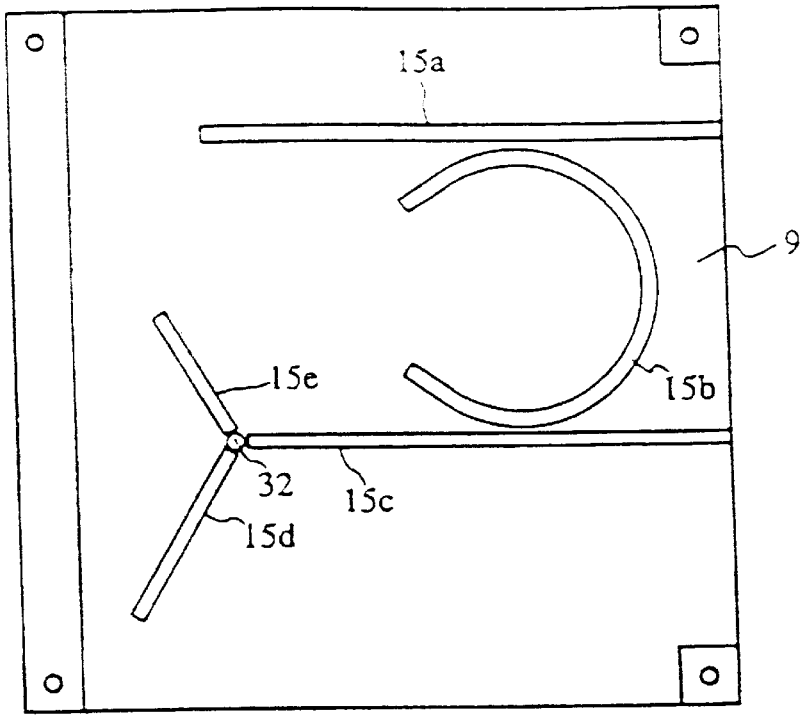
FIGS. 22(A) and 22(B) are illustrations of an FM-CW radar front end in accordance with a sixth embodiment of the present invention.
Figure 22B:
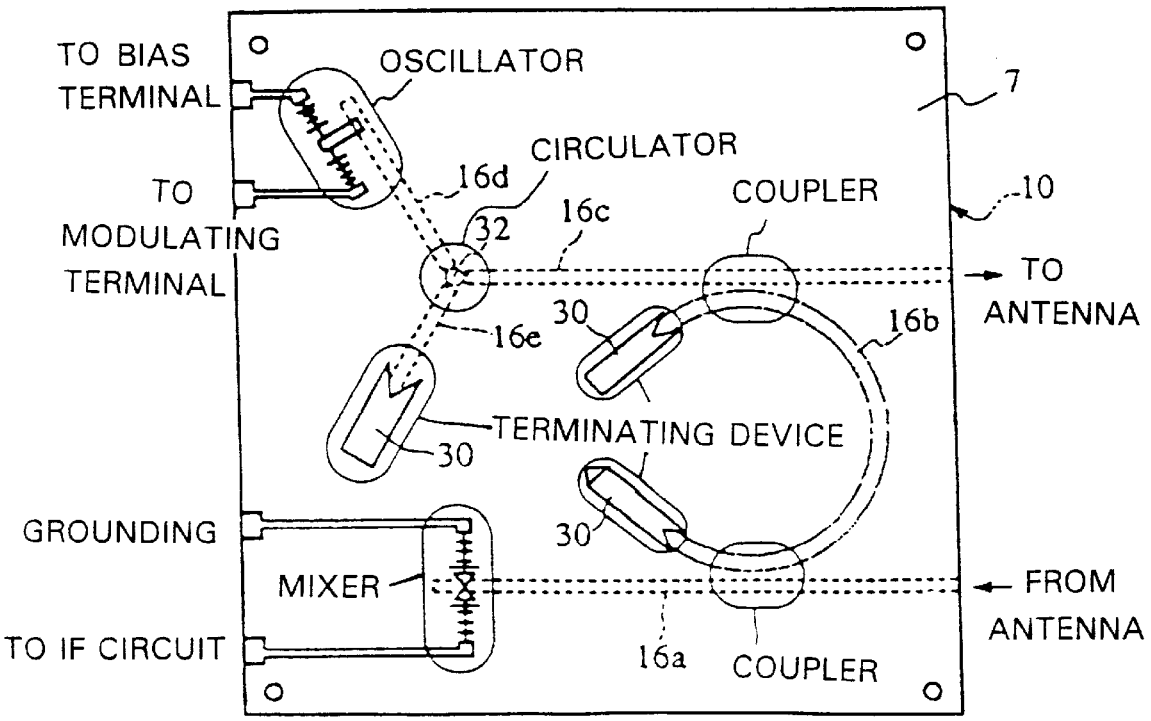

FIGS. 22(A) and 22(B) show the construction of an FM-CW radar front end portion in accordance with a sixth embodiment of the present invention. More specifically, FIG. 22(A) shows the inner surface of an upper metallic flat plate 9, while FIG. 22(B) is a plan view of a lower metallic flat plate 10 carrying a circuit board 7. The upper metallic flat plate 9 has dielectric strips 15*a*, 15*b*, 15*c*, 15*d* and 15*e* arranged in a specific pattern, while the lower metallic flat plate 10 has dielectric strips 16*a*, 16*b*, 16*c*, 16*d* and 16*e* arranged in a pattern which is in mirror-symmetry relation to the pattern of arrangement of the dielectric strips 15*a* to 15*e* on the upper metallic flat plate 9. The circuit board 7 is sandwiched between the metallic flat plates 9 and 10. Conductive film patterns serving as an oscillator, a terminating device and a mixer, as well as a resistor film pattern 30, are formed on the circuit board 7. More specifically, patterns such as a conductor pattern providing an RF choke, a conductor pattern for RF matching and strip lines are formed on the portions of the circuit board 7 which constitute the oscillator and the mixer. A varactor diode and a Gunn diode are provided in the portion constituting the oscillator, while a Schottky barrier diode is provided in the portion constituting the mixer. Each of the metallic flat plates 9, 10 is provided on the inner surface thereof with a ferrite disk 32 and on the outer surface with a magnet (not shown) for applying a D.C. bias magnetic field. The dielectric strips 15*d*, 15*c*, 15*e*, 16*d*, 16*c* and 16*e*, ferrite discs 32 and the magnets in cooperation form a circulator. The dielectric strip 15*e*, 16*e* and a resistor film 30 form the terminating device. The circulator and the terminating device in combination provide an isolator. The gap between the dielectric strips 15*b*, 16*b* and the dielectric strips 15*c*, 16*c* functions as a coupler. Likewise, the gap between the dielectric strips 15*b*, 16*b* and the dielectric strips 15*a*, 16*a* functions as a coupler.

According to the described arrangement, in operation, a signal from the oscillator is transmitted to an antenna via the dielectric strips 15*d*, 16*d*, the circulator and the dielectric strips 15*c*, 16*c*, while a reflected signal is received by another antenna. A synthetic signal synthesized from the received reflected signal and the transmitted signal propagated through the couplers is propagated through the dielectric strips 15*a* and 16*a* so as to be converted into an intermediate frequency signal in the mixer portion.

Figure 28A:
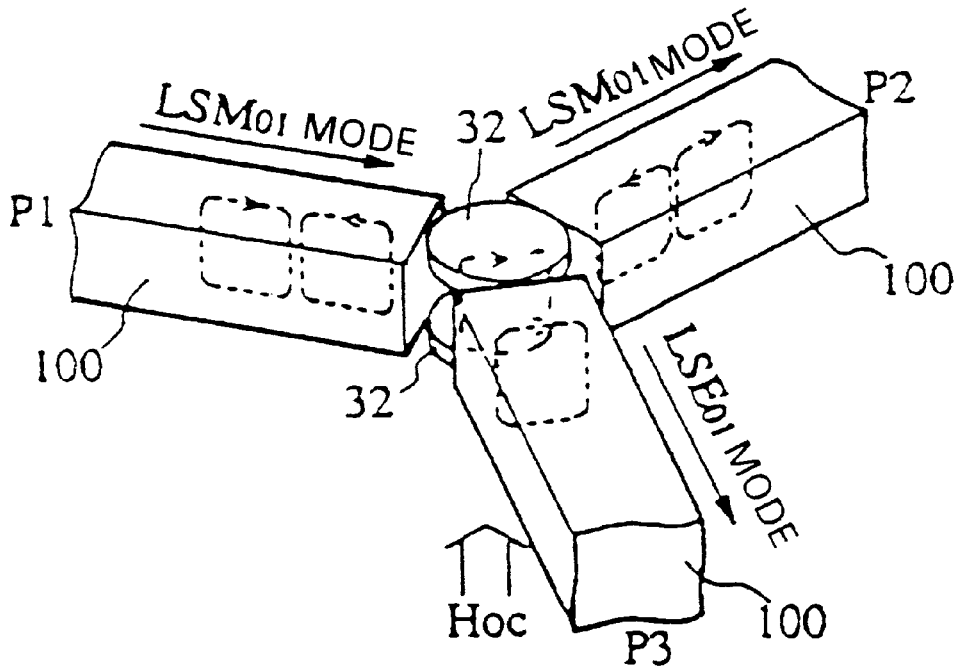
FIG. 28A PRIOR ART
FIGS. 28(A) and 28(B) are perspective views of a circulator composed of conventional dielectric waveguides.
Figure 28B:
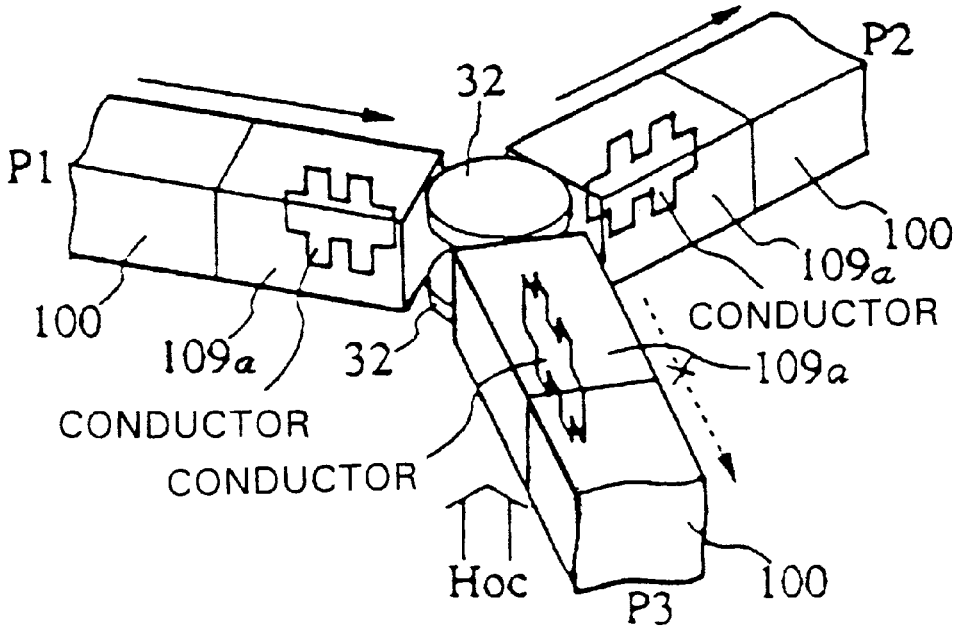
FIG. 28B PRIOR ART

The design factors of the dielectric waveguide constituted by the dielectric strips and the upper and lower metallic flat plates, and more specifically, the distances between the metallic flat plates in the propagating region and in the non-propagating region, and the dielectric constant of the dielectric strips, are so determined that the cut-off frequency of the $LSM_{01}$ mode falls below that of the $LSE_{01}$ mode and such that the frequency in use ranges between the cut-off frequency of the $LSE_{01}$ mode and that of the $LSM_{01}$ mode. Consequently, no design restriction is posed on the radius of curvature of the dielectric strips 15*b*, 16*b*, so that these strips 15*b*, 16*b* can be formed with a radius of curvature which is small enough to appreciably reduce the size of the whole structure of the FM-CW radar front end. In addition, the electromagnetic wave of the $LSE_{01}$ mode does not propagate into the dielectric strips 15*c*, 15*d*, 15*e*, 16*c*, 16*d* and 16*e* at the frequency in use, which eliminates the necessity for a mode suppressor such as the mode suppressor 109*a* shown in FIG. 28(B), thus contributing to a further reduction in the size of the whole structure.

Figure 23:
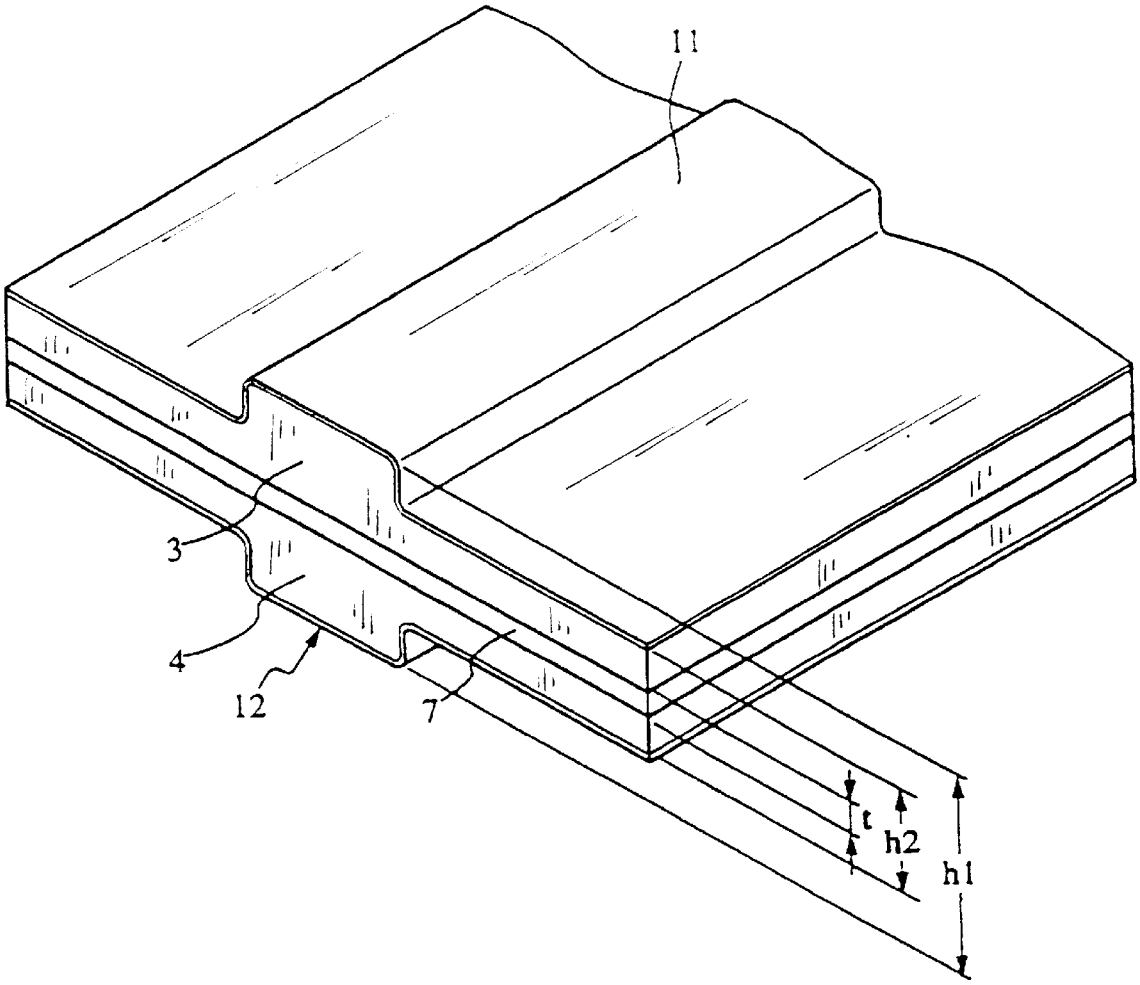
FIG. 23 is a perspective view of a dielectric waveguide in accordance with a seventh embodiment of the present invention.

FIG. 23 is a perspective view of a dielectric waveguide in accordance with a seventh embodiment of the present invention. The height h2 of the non-propagating region of the dielectric waveguide constituted by dielectric members 3, 4 and an intermediate circuit board 7 is determined to be smaller than the height h1 of the propagating region of the dielectric waveguide. The dielectric member 3 is covered with a conductive film 11 at the upper side thereof as viewed in the Figure, while the dielectric member 4 is covered with a conductive film 12 at its lower side as viewed in the Figure. The dielectric members 3 and 4 are assembled together so as to sandwich therebetween the circuit board 7 having a thickness t. The circuit board 7 is provided with strip lines which are coupled with dielectric strips so that the electromagnetic wave of the $LSM_{01}$ mode propagating through the dielectric strips are propagated to the strip lines.

The design factors such as the heights h1, h2, dielectric constant of the dielectric members 3, 4 and the dielectric constant of the circuit board 7, are so determined that the cut-off frequency of the $LSM_{01}$ mode falls below that of the $LSE_{01}$ mode in the propagating region and such that the frequency in use ranges between the cut-off frequency of the $LSE_{01}$ mode and that of the $LSM_{01}$ mode.

Figure 24:
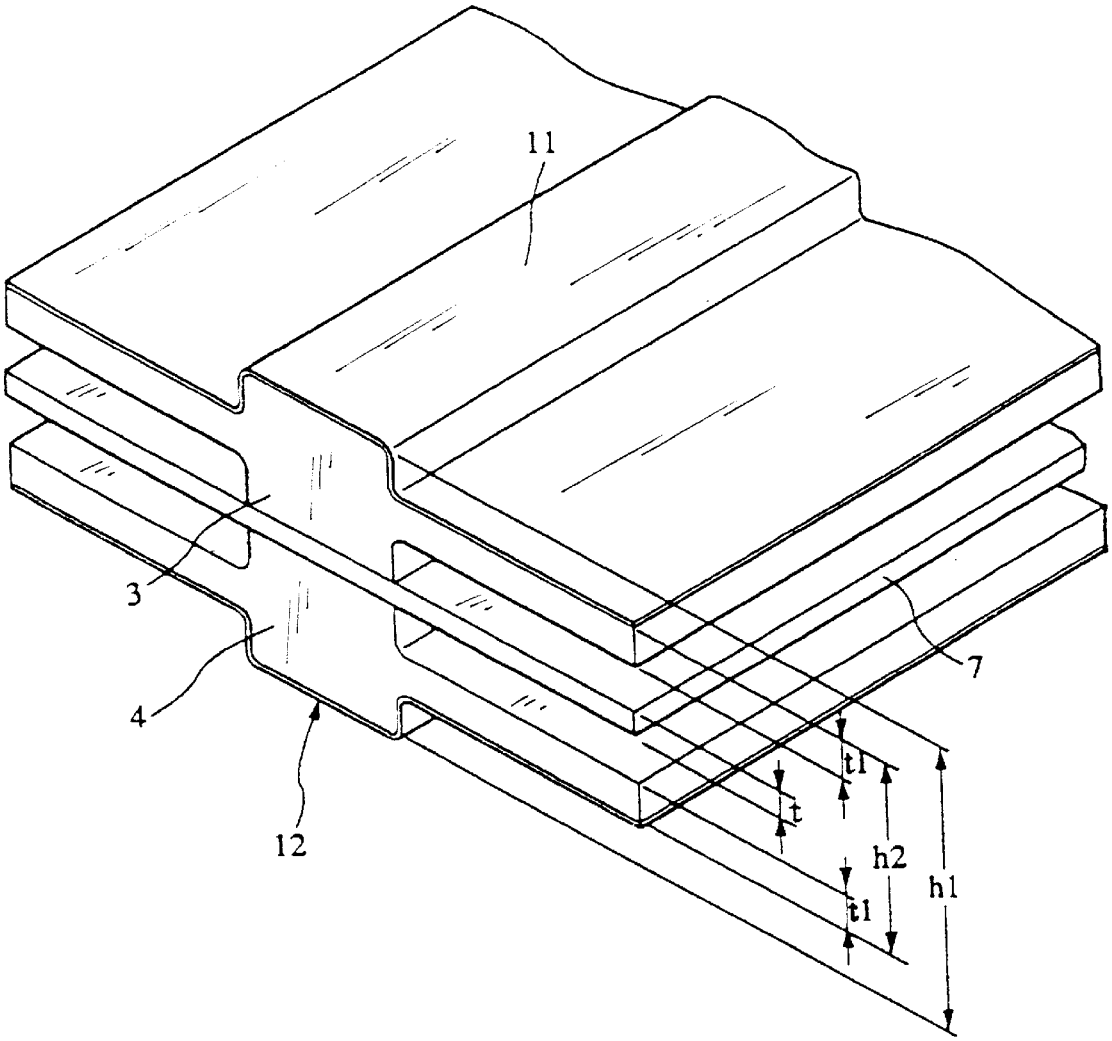
FIG. 24 is a perspective view of a dielectric waveguide in accordance with an eighth embodiment of the present invention.

FIG. 24 is a perspective view of a dielectric waveguide in accordance with an eighth embodiment of the present invention. The height h2 of the non-propagating region of the dielectric waveguide constituted by dielectric members 3, 4 and an intermediate circuit board 7 is determined to be smaller than the height h1 of the propagating region of the dielectric waveguide. The thickness of the non-propagating portion of each dielectric member 3, 4 is determined to be t1. The dielectric member 3 is covered with a conductive film 11 at the upper side thereof as viewed in the Figure, while the dielectric member 4 is covered with a conductive film 12 at its lower side as viewed in the Figure. The dielectric members 3 and 4 are assembled together so as to sandwich therebetween the circuit board 7 having a thickness t. The circuit board 7 is provided with strip lines which are coupled with dielectric strips so that the electromagnetic wave of the $LSM_{01}$ mode propagating through the dielectric strips are propagated to the strip lines.

The design factors such as the heights h1, h2, thicknesses t and t1, dielectric constant of the dielectric members 3, 4, and the dielectric constant of the circuit board 7, are so determined that the cut-off frequency of the $LSM_{01}$ mode falls below that of the $LSE_{01}$ mode in the propagating region and such that the frequency in use ranges between the cut-off frequency of the $LSE_{01}$ mode and that of the $LSM_{01}$ mode.

Figure 25A:
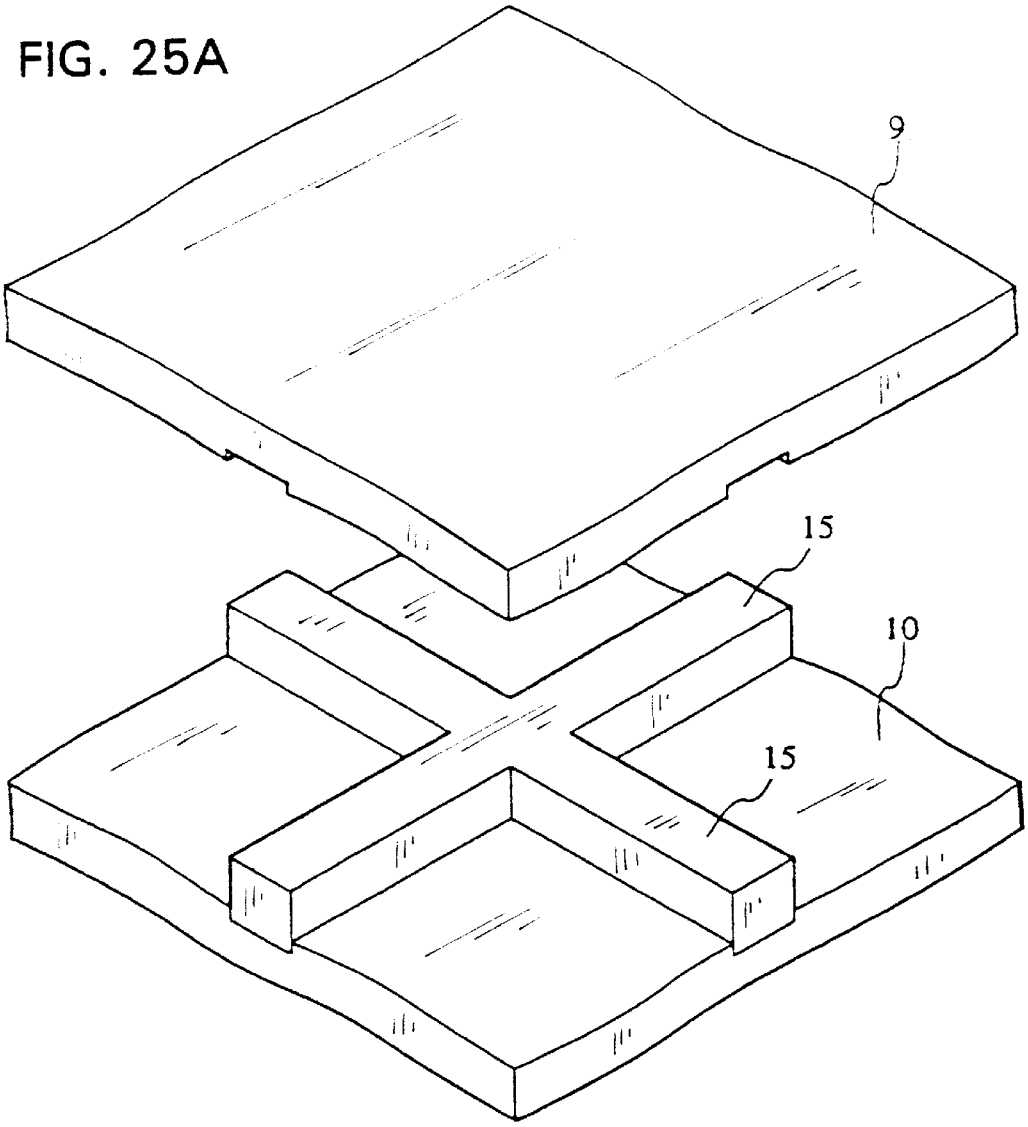
FIGS. 25(A) and 25(B) are an exploded perspective view and a plan view of a dielectric waveguide in accordance with a ninth embodiment of the present invention.

A description will now be given of the construction of a dielectric waveguide in accordance with a ninth embodiment of the present invention, with specific reference to FIGS. 25(A) and 25(B). Referring first to FIG. 25(A) which is an exploded perspective view, metallic flat plates 9, 10 are provided with cross-shaped grooves in their opposing surfaces for receiving a cross-shaped dielectric strip 15. Factors such as the dielectric constant and height of the dielectric strip 15, spacing between the metallic flat plates in the non-propagating region and the depth of the grooves are so determined that the cut-off frequency of the $LSM_{01}$ mode falls below that of the $LSE_{01}$ mode in the propagating region and such that the frequency in use ranges between the cut-off frequency of the $LSE_{01}$ mode and that of the $LSM_{01}$ mode.

Figure 25B:
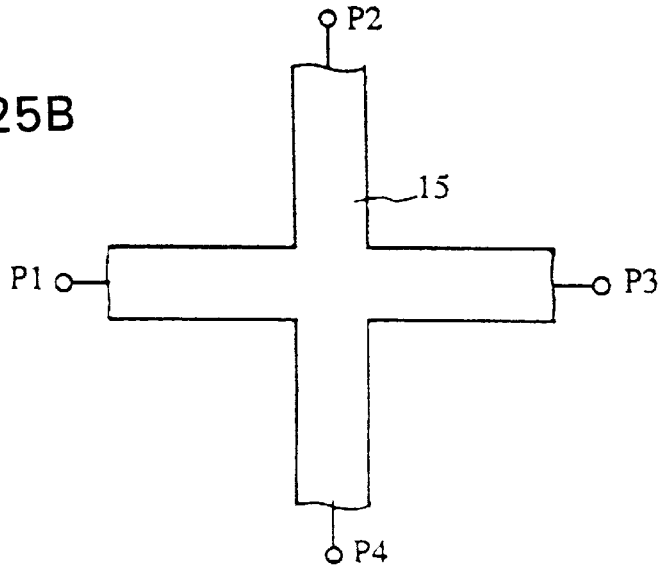
Figure 26A:
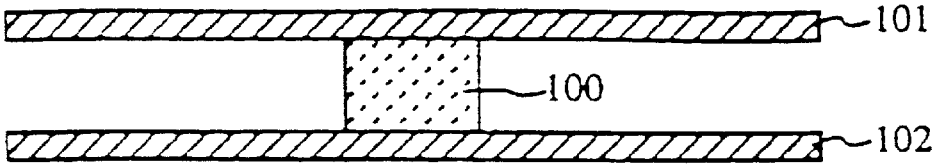
FIG. 26A PRIOR ART
FIGS. 26(A), 26(B), 26(C) and 26(D) are sectional views showing conventional dielectric waveguides of the normal type, the grooved type, the insulated type and the winged type, respectively.
Figure 26B:
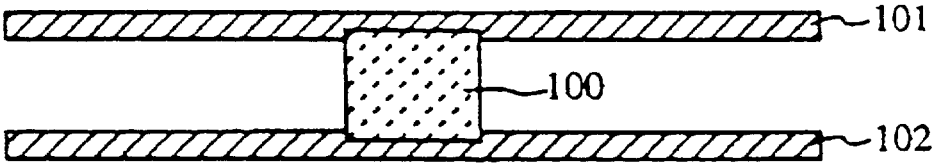
FIG. 26B PRIOR ART
Figure 26C:
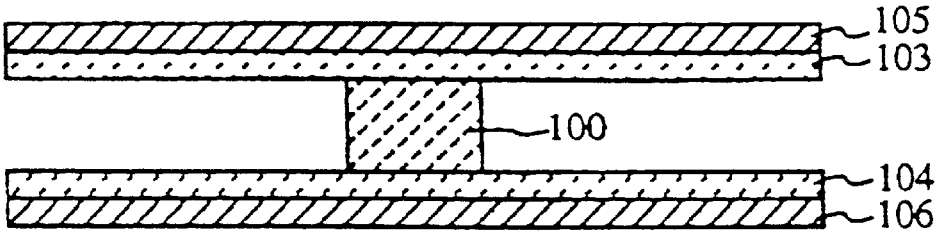
FIG. 26C PRIOR ART
Figure 26D:
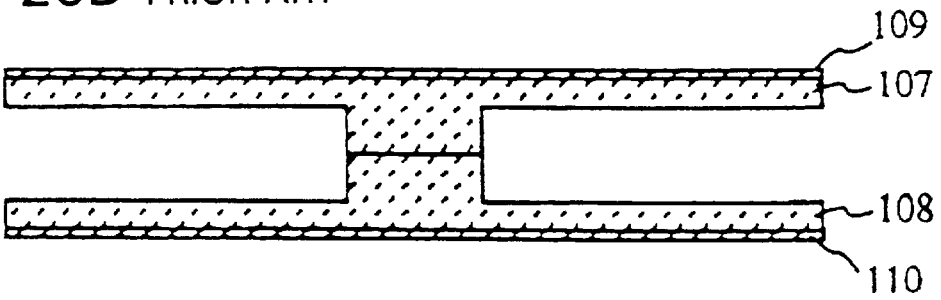
FIG. 26D PRIOR ART
Figure 27:
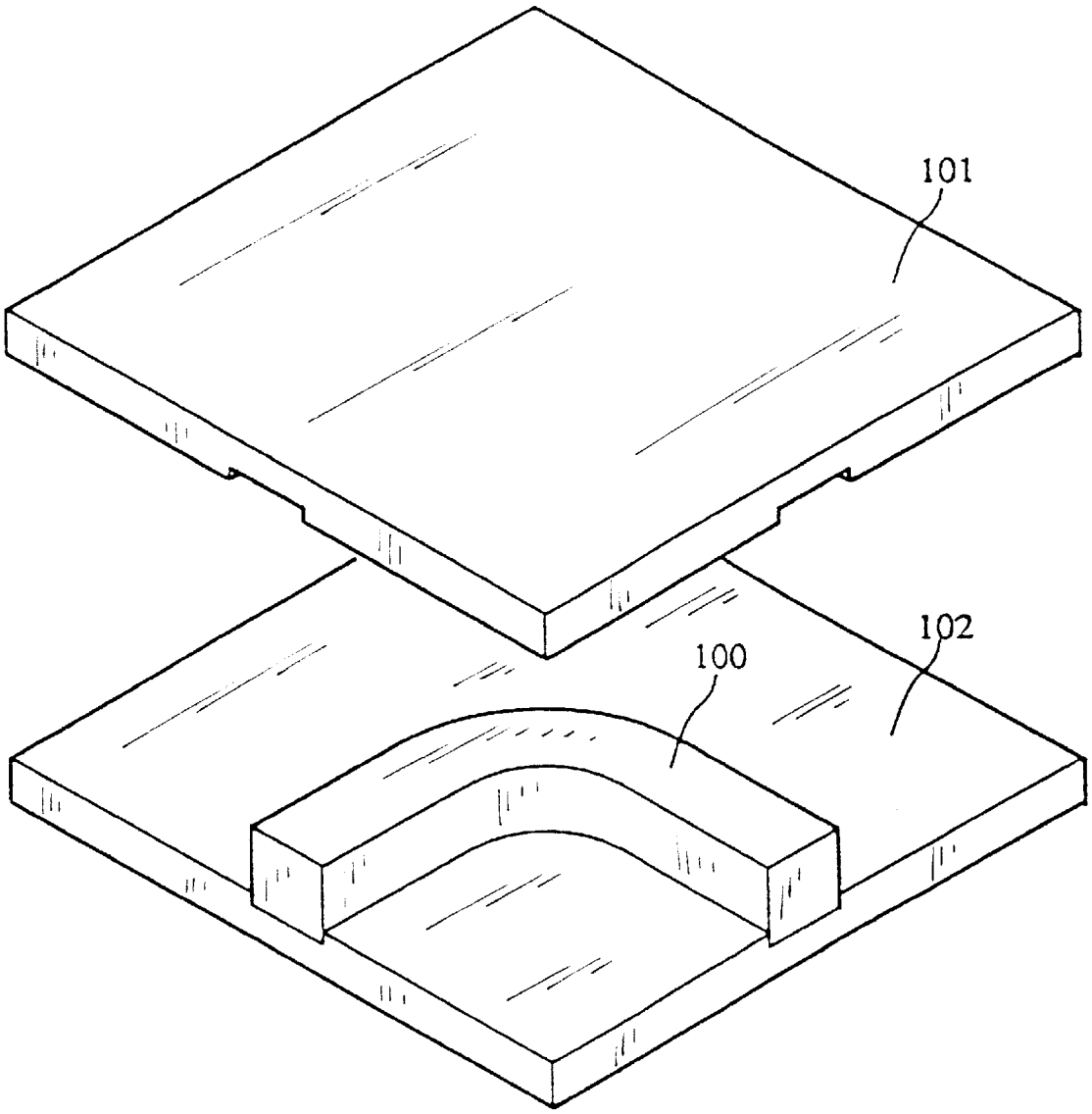
FIG. 27 PRIOR ART
FIG. 27 is a perspective view of a conventional dielectric waveguide, illustrative of the construction of a bend.

Referring now to FIG. 25(B) which is a plan view of the crossing portion of the dielectric strip 15, when an electromagnetic wave of the $LSM_{01}$ mode is propagated from a port P1 to a port P3 at a given frequency, no propagation of an electromagnetic wave of the $LSE_{01}$ mode takes place at that frequency from the crossing point to either a port P2 or to a port P4. In addition, since the portion of the dielectric strip 15 providing the path between the ports P1 and P3 orthogonally crosses the portion of the dielectric strip 15 providing the path between the ports P2 and P4, there is no risk that the electromagnetic wave of the $LSM_{01}$ mode propagating between the ports P1 and P3 is propagated in this mode into the port P2 or P4. This is true also in the case of propagation of an electromagnetic wave in the $LSM_{01}$ mode between the ports P2 and P4. Consequently, an electromagnetic wave in the $LSM_{01}$ mode propagating between the ports P1 and P3 and another electromagnetic wave in the $LSM_{01}$ mode propagating between the ports P2 and P4 can be propagated simultaneously within a common plane independently of each other.

As will be understood from the foregoing description, the present invention offers the following advantages.

According to the first to sixth aspects of the present invention, the $LSM_{01}$ mode is the mode of the lowest order. Therefore, no conversion of mode from the $LSM_{01}$ to the $LSE_{01}$ mode occurs at a bend if the frequency of the wave is selected to range between the cut-off frequency for the $LSE_{01}$ mode and that for the $LSM_{01}$ mode, so that the transmission loss which hitherto has been caused as a result of such a mode conversion is eliminated. This makes it possible to design a bend with any desired bend angle and radius of curvature. It is therefore easy to reduce the area to be occupied by the bend and, hence, to reduce the size of the whole device, by increasing the angle of bend or by reducing the radius of curvature.

For example, a circulator constructed by using a dielectric waveguide according to the present invention does not necessitate any mode suppressor which hitherto has been necessary for the purpose of suppressing the $LSE_{01}$ mode, thanks to the elimination of conversion from the $LSM_{01}$ mode to the $LSE_{01}$ mode. Consequently, the area to be occupied by the circulator is reduced so as to make it easy to reduce the size of the whole device.

When it is desired to arrange a pair of dielectric strips in a mutually crossing manner, the present invention makes it possible to arrange these dielectric strips so that they cross each other in a common plane, without causing any interference between the electromagnetic waves propagating through these dielectric strips, making it easy to reduce the size of the whole device incorporating such crossing dielectric strips.

Furthermore, the dielectric waveguide in accordance with the seventh aspect of the present invention is easy to fabricate, even when a large difference exists between the spacing of the conductor surfaces in the propagating region and the spacing of the conductor surfaces in the non-propagating region.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric waveguide, comprising:

a substantially parallel pair of conductor flat surfaces; and a dielectric strip interposed between said pair of conductor flat surfaces, said dielectric strip providing a propagating region which can propagate electromagnetic waves associated with the $LSM_{01}$ mode and the $LSE_{01}$ mode, while regions apart from said dielectric strip provide a non-propagating region which can cut off said electromagnetic waves;

wherein a spacing h2 between said conductor flat surfaces in said non-propagating region is smaller than a spacing h1 between said conductor flat surfaces in said propagating region, and wherein said spacings h1 and h2, a dielectric constant ∈1 of said dielectric strip in said propagating region and a dielectric constant ∈2 of a dielectric layer in said non-propagating region are such that a cut-off frequency of the $LSM_{01}$ mode when propagating through said propagating region is lower than a cut-off frequency of the $LSE_{01}$ mode and that electromagnetic waves associated with both the $LSM_{01}$ mode and the $LSE_{01}$ mode can be cut-off in said non-propagating region.

2. A dielectric waveguide according to claim 1, further comprising an additional dielectric layer disposed at least in said non-propagating region, said additional dielectric layer having a thickness t and a dielectric constant ∈3, wherein said dielectric constant ∈3 and said thickness t, in addition to said spacings h1 and h2, and said dielectric constants ∈1, ∈2, are such that the cut-off frequency of the $LSM_{01}$ mode when propagating through said propagating region is lower than the cut-off frequency of the $LSE_{01}$ mode and that electromagnetic waves associated with both the $LSM_{01}$ mode and the $LSE_{01}$ mode can be cut-off in said non-propagating region.

3. A dielectric waveguide according to claim 2, wherein said additional dielectric layer is further disposed in said propagating region.

4. A dielectric waveguide according to claim 1, wherein each said conductor flat surface comprises a respective metallic film, on said dielectric strip, said dielectric strip being comprised of an injection-molded resin or ceramics material.

5. A dielectric waveguide, comprising:

a substantially parallel pair of conductor flat surfaces; and a dielectric member interposed between said pair of conductor flat surfaces, so as to provide a propagating region which can propagate electromagnetic waves associated with the $LSM_{01}$ mode and the $LSE_{01}$ mode between said conductor flat surfaces, and a non-propagating region which can cut off said electromagnetic waves;

wherein a spacing h2 between said conductor flat surfaces in said non-propagating region is smaller than a spacing h1 between said conductor flat surfaces in said propagating region, and wherein said spacings h1 and h2, and a dielectric constant ∈1 of said dielectric member are such that a cut-off frequency of the $LSM_{01}$ mode when propagating through said propagating region is lower than a cut-off frequency of the $LSE_{01}$ mode and that electromagnetic waves associated with both the $LSM_{01}$ mode and the $LSE_{01}$ mode can be cut-off in said non-propagating region.

6. A dielectric waveguide according to claim 5, further comprising: an additional dielectric layer disposed at least in said non-propagating region, said additional dielectric layer having a thickness t and a dielectric constant ∈3, wherein said dielectric constant ∈3 and said thickness t, in addition to said spacings h1 and h2, and said dielectric constant ∈1, are such that the cut-off frequency of the $LSM_{01}$ mode when propagating through said propagating region is lower than the cut-off frequency of the $LSE_{01}$ mode and that electromagnetic waves associated with both the $LSM_{01}$ mode and the $LSE_{01}$ mode can be cut-off in said non-propagating region.

7. A dielectric waveguide according to claim 6, wherein said additional dielectric layer is further disposed in said propagating region.

8. A dielectric waveguide, comprising:

a substantially parallel pair of conductor flat surfaces; and a dielectric member interposed between said pair of conductor flat surfaces, so as to provide a propagating region which can propagate electromagnetic waves associated with the $LSM_{01}$ mode and the $LSE_{01}$ mode between said conductor flat surfaces, and a non-propagating region which can cut off said electromagnetic waves;

wherein a spacing h2 between said conductor flat surfaces in said non-propagating region is smaller than a spacing h1 between said conductor flat surfaces in said propagating region, said dielectric member being disposed in said propagating region and having a dielectric constant ∈1, said dielectric waveguide further comprising first and second dielectric layers extending from said propagating region and into said non-propagating region and having the dielectric constant ∈1, and a third dielectric layer disposed in said non-propagating region between said first and second dielectric layers and having a dielectric constant ∈2, and wherein said spacings h1 and h2, the dielectric constant ∈1, ∈2 and the thickness of said first and second dielectric layers extending into said non-propagating region and having the dielectric constant ∈1 are such that a cut-off frequency of the $LSM_{01}$ mode when propagating through said propagating region is lower than a cut-off frequency of the $LSE_{01}$ mode and that electromagnetic waves associated with both the $LSM_{01}$ mode and the $LSE_{01}$ mode can be cut-off in said non-propagating region.

9. A dielectric waveguide according to claim 8, further comprising an additional dielectric layer disposed in said non-propagating region, said additional dielectric layer having a thickness t and a dielectric constant ∈3, wherein said dielectric constant ∈3 and said thickness t, in addition to said spacings h1 and h2, and said dielectric constants ∈1, ∈2, are such that the cut-off frequency of the $LSM_{01}$ mode when propagating through said propagating region is lower than the cut-off frequency of the $LSE_{01}$ mode and that electromagnetic waves associated with both the $LSM_{01}$ mode and the $LSE_{01}$ mode can be cut-off in said non-propagating region.

10. A dielectric waveguide according to claim 9, wherein said additional dielectric layer is further disposed in said propagating region.

11. A dielectric waveguide according to any one of claims 5 and 8, wherein each said conductor flat surface comprises a respective metallic film on said dielectric member, said dielectric member being comprised of an injection-molded resin or ceramics material.

* * * * *